US012595116B2

(12) United States Patent
Rivera

(10) Patent No.: US 12,595,116 B2
(45) Date of Patent: Apr. 7, 2026

(54) DISPOSABLE MILK CARTRIDGE

(71) Applicant: Adrian Rivera, Whittier, CA (US)

(72) Inventor: Adrian Rivera, Whittier, CA (US)

( * ) Notice: Subject to any disclaimer, the term of this patent is extended or adjusted under 35 U.S.C. 154(b) by 0 days.

(21) Appl. No.: 18/213,364

(22) Filed: Jun. 23, 2023

(65) Prior Publication Data

US 2024/0425268 A1 Dec. 26, 2024

(51) Int. Cl.
*B65D 85/804* (2006.01)

(52) U.S. Cl.
CPC ..... *B65D 85/8049* (2020.05); *B65D 85/8046* (2013.01); *B65D 85/8067* (2020.05)

(58) Field of Classification Search
CPC ..... B65D 85/804–85/8067
See application file for complete search history.

(56) References Cited

U.S. PATENT DOCUMENTS

| | | | | |
|---|---|---|---|---|
| 2,968,560 | A | 1/1961 | Nathan | |
| 4,471,689 | A * | 9/1984 | Piana | B65D 85/8043 426/77 |
| 4,853,234 | A * | 8/1989 | Bentley | B65D 85/8052 D7/400 |
| 10,039,414 | B2 | 8/2018 | Moon et al. | |
| 10,040,042 | B2 | 8/2018 | Showalter | |
| 10,058,208 | B2 | 8/2018 | Smith et al. | |
| 10,362,893 | B2 | 7/2019 | Dogan et al. | |
| 10,543,977 | B2 | 1/2020 | Brockman et al. | |
| 10,945,556 | B2 | 3/2021 | Wong | |
| 11,058,251 | B2 | 7/2021 | Tonelli et al. | |
| 11,066,231 | B2 | 7/2021 | Kelly et al. | |
| 11,083,325 | B2 | 8/2021 | Piras et al. | |
| 2004/0228955 | A1 | 11/2004 | Denisart et al. | |
| 2009/0004335 | A1 | 1/2009 | Macmahon et al. | |
| 2009/0223375 | A1 * | 9/2009 | Verbeek | B67D 1/0021 99/287 |

(Continued)

FOREIGN PATENT DOCUMENTS

| | | |
|---|---|---|
| WO | WO-2024263322 A2 | 12/2024 |
| WO | 2024263322 | 1/2025 |

OTHER PUBLICATIONS

"NanoFoamer PRO—An Automatic Microfoam Maker", Indiegogo, Inc., [Online]. Retrieved from the Internet: <URL: https://www.indiegogo.com/projects/nanofoamer-pro-an-automatic-microfoam-maker?utm_source=cordial&utm_medium=email&utm_campaign=230608_thursday_2023-06-08#/>, (Accessed Apr. 17, 2024), 4 pgs.

(Continued)

*Primary Examiner* — Viren A Thakur
*Assistant Examiner* — Chaim A Smith
(74) *Attorney, Agent, or Firm* — Schwegman Lundberg & Woessner, P.A.

(57) ABSTRACT

A disposable milk pod including an internal chamber containing fluid, a bottom portion, a top portion, wherein the top portion comprises a barrier, and a wall portion connecting the bottom and top portion. Prior to the disposable single serving milk pod engaging with a pod processing device, the barrier, the bottom portion, and the wall portion seal the milk within the internal chamber. In response to the single serving milk pod engaging with the pod processing device, the pod processing device pierces one or more portions of the barrier and injects a hydrous liquid such as water and/or steam into the internal chamber, such that the milk mixes with the hydrous liquid.

21 Claims, 11 Drawing Sheets

(56) References Cited

U.S. PATENT DOCUMENTS

| | | | | |
|---|---|---|---|---|
| 2013/0186280 | A1 | 7/2013 | Sekiguchi | |
| 2014/0154391 | A1 | 6/2014 | Mehta et al. | |
| 2015/0017290 | A1* | 1/2015 | Rondelli | A23F 5/262 426/115 |
| 2015/0050391 | A1* | 2/2015 | Rapparini | B65D 85/8043 426/115 |
| 2015/0072049 | A1 | 3/2015 | Oh | |
| 2017/0251866 | A1 | 9/2017 | Garcia | |
| 2019/0328170 | A1 | 10/2019 | Cai | |
| 2021/0024283 | A1* | 1/2021 | Brivois | B65D 65/466 |
| 2021/0339942 | A1* | 11/2021 | Tonelli | B65D 85/8052 |

OTHER PUBLICATIONS

"International Application Serial No. PCT/US2024/030009, International Search Report mailed Aug. 28, 24", 2 pgs.
"International Application Serial No. PCT/US2024/030009, Written Opinion mailed Aug. 28, 2024", 5 pgs.
"International Application Serial No. PCT US2024 0300, Demand Article 34 filed Apr. 22, 2025", 14 pgs.
"International Application Serial No. PCT US2024 030009, International Preliminary Report on Patentability mailed Sep. 10, 2025", 7 pgs.

* cited by examiner

DISPOSABLE MILK CARTRIDGE

BACKGROUND

Coffee pods are typically single-serving, pre-packaged coffee capsules designed for use with certain brewing systems. These pods contain a precise amount of ground coffee, sealed within a small, air-tight plastic container topped with a foil or plastic lid. A built-in paper or mesh filter is used to ensure that the beverage is brewed without any coffee grounds or residue ending up in the coffee cup.

BRIEF DESCRIPTION OF THE SEVERAL VIEWS OF THE DRAWINGS

In the drawings, which are not necessarily drawn to scale, like numerals may describe similar components in different views. To identify the discussion of any particular element or act more easily, the most significant digit or digits in a reference number refer to the figure number in which that element is first introduced. Some non-limiting examples are illustrated in the figures of the accompanying drawings in which.

DETAILED DESCRIPTION

Figure 3:
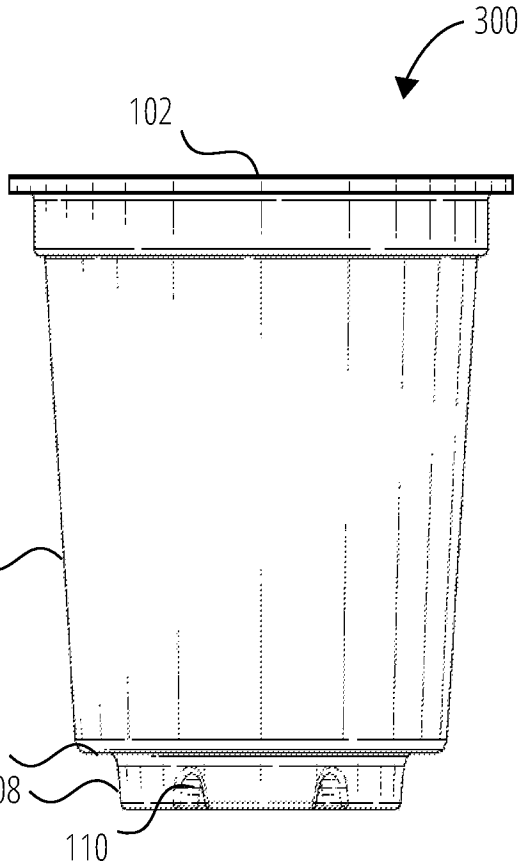
FIG. 3 illustrates a left view of the milk cartridge of FIG. 1, according to some examples.

Steam and milk play a crucial role in creating various coffee drinks, particularly in the world of espresso-based beverages. The process of steaming milk not only heats the milk but also introduces air into the milk, resulting in a creamy, frothy texture that adds a unique mouthfeel and enhances the overall coffee experience. Steamed milk is an essential component in popular coffee drinks such as lattes, cappuccinos, macchiatos, and flat whites.

Traditional coffee making systems froth milk using a steam wand on an espresso machine. The steam wand releases pressurized steam that heats and aerates the milk simultaneously. The barista submerges the tip of the steam wand just below the milk's surface in a stainless steel pitcher and then turns on the steam. As steam is injected into the milk, the milk heats up and creates microfoam-tiny air bubbles that give the milk a velvety texture.

Some traditional coffee machines can come equipped with a milk frother feature that allows users to create steamed and frothed milk for their coffee drinks, such as lattes and cappuccinos. These machines have a separate milk frother unit or attachment, which uses a different method than steam wands found on espresso machines to create frothed milk.

These coffee machines with milk frothing capabilities can use an electric milk frother unit or a frother attachment. The frother may be integrated into the coffee maker or come as a standalone device. These frothers use a small whisk or frothing disc, which is submerged in the milk and rapidly spins when the frother is turned on.

To create frothed milk, the user pours cold milk into the frother pitcher, ensuring not to exceed the maximum fill line. The frother is then switched on, causing the whisk or frothing disc to spin, introducing air into the milk and creating froth. Simultaneously, the frother heats the milk (such as by spinning or increasing temperature of the wand), achieving a similar effect to traditional steam wand frothing.

Once the milk has been heated and/or frothed, the milk can be combined manually by pouring the milk into the coffee to create espresso-style beverages like lattes, cappuccinos, or flat whites.

The disposable coffee machines (such as coffee pod machines or single serve coffee machines) described herein improve and/or eliminate some of the pitfalls of traditional coffee pod machines. In some examples, the use of pods can also provide a more consistent outcome, ensuring that each beverage has precise and desired milk characteristics. For simplicity, the application is described as one type of machine, such as a pod device or single serve coffee machine, but it is appreciated that other types of machines or pods apply.

In some examples, with milk pods, the milk, cream, artificial creamer, milk powder, condensed milk, whipped cream, and/or the like is contained within the pod, significantly reducing the need for cleaning and maintenance. Moreover in some examples, milk pods can be produced with a range of milk types and milk alternatives, offering greater flexibility and variety to users. In some cases, milk pods can include a precise amount of milk resulting in consistent results. Although examples described herein apply a particular substance, such as milk, it is appreciated that the examples apply to the other types of substance, such as the other types described herein, other types of powders and/or liquids, teas, coffee, baby formula, creamer, cream, and/or the like. Accordingly, when the present application refers to milk or a milk pod herein, it should be appreciated that, unless otherwise specified, it is intended that the term milk refer to all types of liquids and solids that could be included in the pod including those referenced above.

Furthermore in some examples, some milk pods can be pre-packaged and can be designed to be shelf-stable, reducing waste and extending the shelf life of the liquid. In some examples, the heating process within the milk pod can be more precisely controlled, ensuring that the milk is heated to the correct temperature for optimal flavor and texture. In some examples, the milk pods can be designed with varying levels of frothiness or creaminess, providing greater customization options for users.

In some examples, the perforating components of the pod processing device either obviates touching of milk and/or reduces the amount of contact with the milk, which helps to mitigate or eliminate the risk of heated milk attracting bacteria or other contaminants onto the pod processing device. Such an internal pod structure can, in some examples, also eliminate or reduce the need to remove or clean the milk or other residue on pod processing device surfaces. Although examples described herein apply a particular type of pod or cartridge, such as a milk pod or milk cartridge, it is appreciated that the examples apply to the other types of pods, such as a coffee pod, a tea pod, a baby formula pod, and/or the like. In some examples, an additive pod is applied, where a liquid and/or powder is stored within the chamber of the additive pod to be added to another substance, such as hot water for tea or baby formula, coffee for a latte, and/or the like.

In some examples, utilizing the milk pods described herein that can be punctured to heat and froth the milk addresses pitfalls associated with traditional coffee pod machines and their frothing features, offering a more convenient, consistent, and customizable experience for users who enjoy coffee drinks with steamed, frothed or heated milk or other coffee additives.

External Features of the Milk Cartridge

Figure 2:
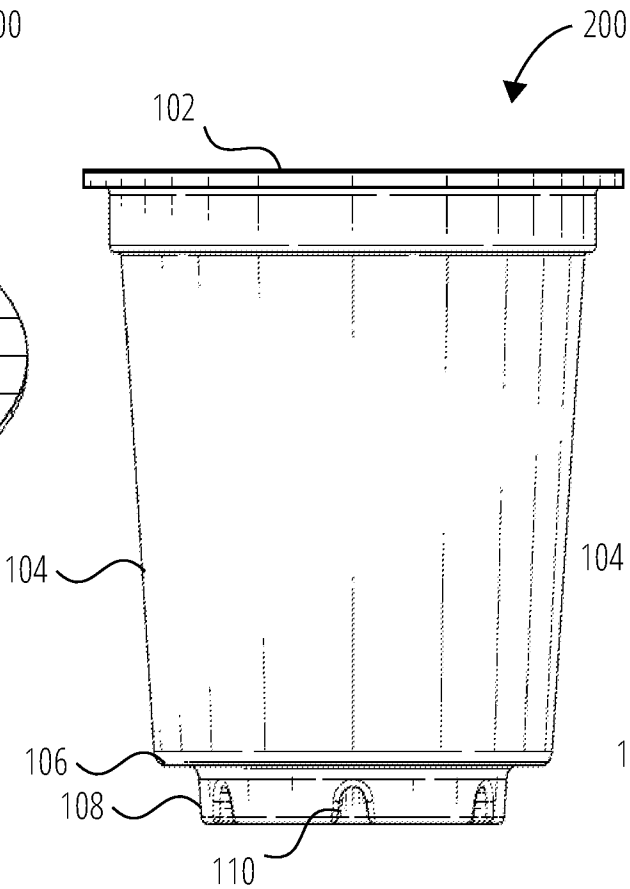
FIG. 2 illustrates a front view of the milk cartridge of FIG. 1, according to some examples.
Figure 1:
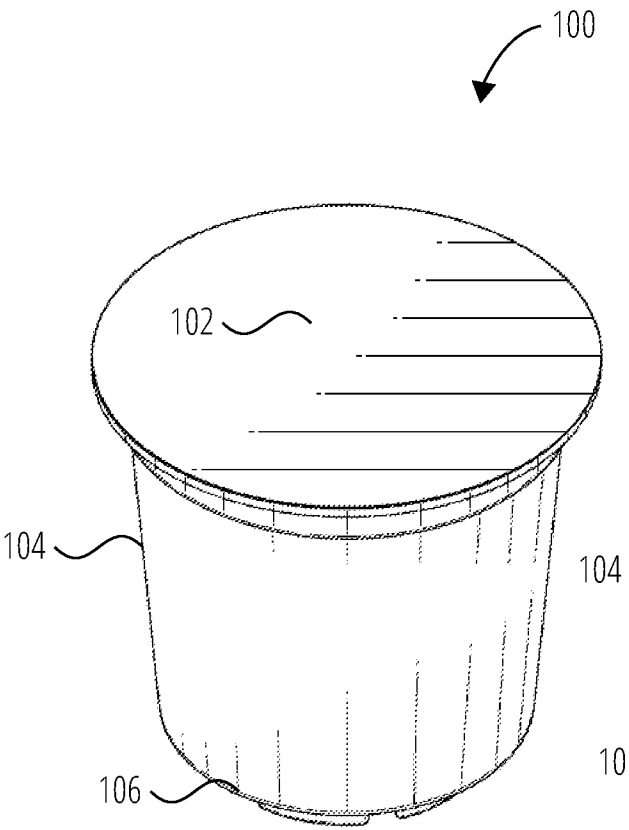
FIG. 1 illustrates a perspective view of a milk cartridge, according to some examples.
Figure 5:
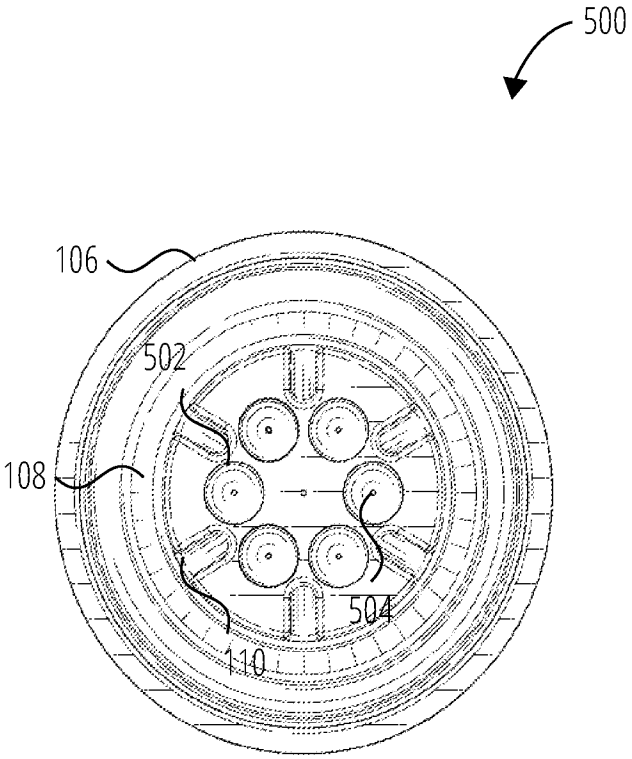
FIG. 5 illustrates a bottom view of the milk cartridge of FIG. 1, according to some examples.
Figure 4:
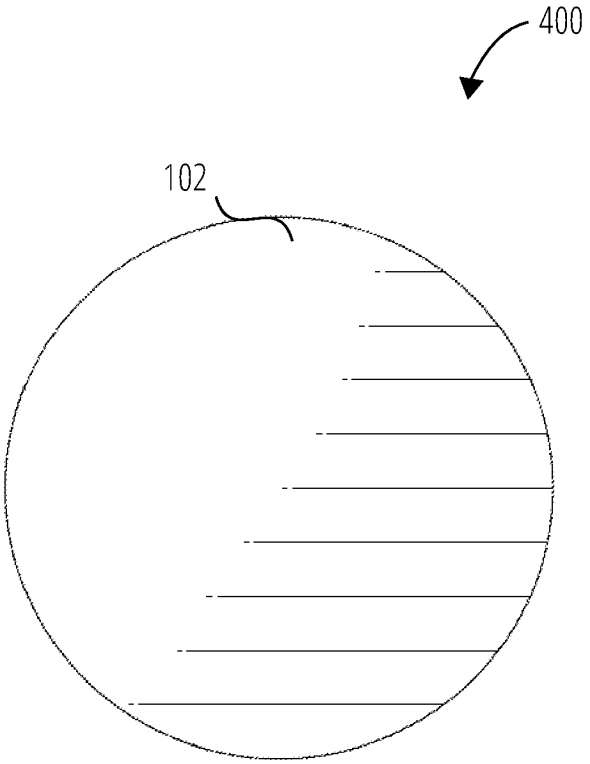
FIG. 4 illustrates a top view of the milk cartridge of FIG. 1, according to some examples.

FIG. 1 illustrates a perspective view 100 of a milk cartridge, according to some examples. FIG. 2 illustrates a front view 200 of the milk cartridge of FIG. 1, according to some examples. FIG. 3 illustrates a left view 300 of the milk cartridge of FIG. 1, according to some examples. FIG. 4 illustrates a top view 400 of the milk cartridge of FIG. 1, according to some examples. FIG. 5 illustrates a bottom view 500 of the milk cartridge of FIG. 1, according to some examples.

In the example of FIG. 1, the milk cartridge, such as a disposable milk pod, is a container that holds milk in a compact, sealed format, intended for use with single-serve pod processing machines. This innovative pod design allows users to conveniently create enhanced beverages, such as lattes and cappuccinos, without the need for a separate frother or steamer.

One version of the milk pod shown in FIG. 1 features a top portion 102 with a pierceable barrier (such as a pierceable membrane), a bottom portion 108, a shelf 106, a wall portion 104 connecting the top portion 102 and the bottom portion 108, and an internal chamber containing milk.

The top portion 102 of a milk-filled pod features a barrier, which can be a puncturable seal, such as material made of foil or plastic film. In this embodiment, when the pod is inserted into the pod processing machine, the machine pierces the barrier, allowing hydrous liquids, such as hot water, water vapor, steam, air, other fluids, and/or the like, to be injected into the pod. This process helps to heat and mix the milk inside the pod. The pod machine can compromise the pod in order to inject the hydrous liquid by piercing the pod, puncturing the pod, removing the barrier, and/or the like. For the sake of simplicity, examples herein describe one type, such as hydrous liquids, but it is appreciated that other substances such as other fluids apply. For example, the substances described herein (e.g., hydrous liquids) can include water, steam, air and/or milk.

The bottom portion 108 of the pod serves as the base and provides structural stability. The bottom portion 108 can be made of a rigid plastic material. In some cases, the bottom portion 108 includes recesses, such as recess 110, that further provide structural stability for the pod and/or align the pod with the pod processing device. Such recesses 110 create a channel in between the recesses 110 for the milk around the exit points. In some cases, the bottom portion 108 also includes a puncturable seal or exit points, such as exit point 502, that allow the heated and mixed milk to flow out of the pod and into the user's cup when the brewing process is completed.

In some cases, the exit points 502 can be surrounded by a recess and/or protrusion. For example, the exit points 502 can be surrounded by a recess, such as a half dome shape, that recesses into the milk pod. As such, when the milk exits from the exit points 502, the milk can spread out to enhance aeration. Moreover, the recess and/or protrusions can be made of a thinner material than other portions of the milk pod. As such during the manufacturing process, the molds can effectively create such small exit points for the milk to exit without compromising the structural integrity of the milk pod.

In some cases, the recesses 110 create a raised floor, higher than the bottom surface of the pod. As such, when a piercing component attempts to pierce the bottom membrane (further described below), the recesses 110 hold the bottom membrane such that the piercing component can more effectively pierce the bottom membrane than if the recesses were not present. For example, if the recesses were not present, the bottom membrane could instead bend much further resisting the piercing.

The wall portion 104 connects the top and bottom portions of the pod, creating a closed container. This wall portion 104 can be made of the same rigid plastic material as the bottom portion 108. The wall portion 104 not only provides structural support but also helps to maintain the integrity of the pod during the brewing process, ensuring the liquid or powder inside remains contained and uncontaminated until it is ready to be dispensed.

The internal chamber within the pod is where the milk is stored. This chamber is sealed by the top portion 102 and the bottom portion 108, as well as the wall portion 104, keeping the milk fresh and protected from external contaminants. When the pod processing device pierces the top barrier and injects hydrous liquids, the milk inside the chamber gets heated and mixed, creating a frothy, steamed milk beverage that can be used for various coffee drinks.

The disposable single serving milk pod is designed to keep the milk fresh and uncontaminated until it is ready to be used. Prior to engaging with a pod processing device, the barrier, bottom portion 108, and wall portion 104 work together to create a sealed internal chamber that contains the milk.

When the single serving milk pod is inserted into the pod processing device, the machine's mechanism pierces one or more portions of the barrier. This allows a hydrous liquid, typically hot water or steam, to be injected into the internal chamber where the milk is stored, and preferably injected at a point below the fill level of the liquid. As the hydrous liquid enters the chamber, it mixes with the milk, effectively heating and frothing the milk. This process ensures that the milk is only exposed to external elements when it's being used, maintaining its freshness and quality. In some cases, the one or more perforating components can enter the pod via one or more holes, such as holes at the top portion of the pod.

Once the mixing process is complete, the heated and frothy milk is dispensed from the bottom portion 108 of the pod into the user's cup. The milk pod offers a convenient and mess-free solution for those who want to enjoy a variety of milk-based coffee or other beverages at home or in the office without the need for additional equipment.

In some cases, the milk pod has one or more holes to enable exiting of the milk, such as hole 504. The exit holes in the milk pod are strategically sized to facilitate a certain amount of air to be fused with the milk as it exits the pod. As the frothed milk passes through these holes, air is drawn into the milk stream, creating tiny air bubbles. The pressure difference between the inside of the pod and the outside environment aids in this process.

The size of the exit holes determines the amount of frothing added to the already frothed milk. The narrow diameter of the small holes forces the frothed milk to pass through at high velocity, resulting in increased shear forces. These forces help break down the milk's fat globules and protein molecules, causing them to form a stable foam structure with the incorporated air bubbles. The diameter of the exit holes can range from 0.01 mm to 5 mm, preferably between 0.1 and 1 mm. The dimples on the bottom of the pod can vary from 1-10 mm in diameter.

Moreover, as the frothy milk exits the pod through the small holes, the sudden release of pressure causes the air bubbles in the milk to expand. This expansion, combined with the milk's fat and protein molecules, creates a stable foam structure that maintains the frothy texture of the milk.

In some cases, the milk pod has indents (shown in FIG. 5) that can be punctured by one or more needles of a pod processing device to create holes when the pod engages with the pod processing device. The size and shape of the indents and the holes 504 can vary depending on the desired effect on the frothing.

In some cases, the milk pod can be a reusable pod. The reusable pod can be used to create frothy milk. The user can then clean the reusable pod and refill the chamber with new milk to be reused to create frothy milk at a later time. In some cases, the reusable pod can enable exit of the frothy milk from the pod without having a bottom barrier to pierce, which enables the pod to be reusable. In other cases, the barrier can be pierced multiple times, such as via the blades (described further herein).

The reusable pod can comprise materials that can withstand multiple iterations of exposure to high temperature and pressure. The refillable pod can include an opening at the top portion to enable a user to open and refill the chamber with fresh milk or other liquid or powder, such as via a sealable opening or detachable lid. The reusable pod can include a channel enabling the steam, such as the internal channel 608, to inject steam (e.g., injecting below the surface of the milk).

In some cases, the pods can be made in different shapes and sizes for the same pod processing device. For example, the pods of different diameters and/or depths can be applied to the same pod processing device using a ring or other adapter to accommodate for smaller diameter cups. In some cases, the ring adapter can be engaged with the pod. In other cases, the ring adapter is a part of the pod processing device (such as on the pod interface).

Internal Features of the Milk Cartridge

Figure 8:
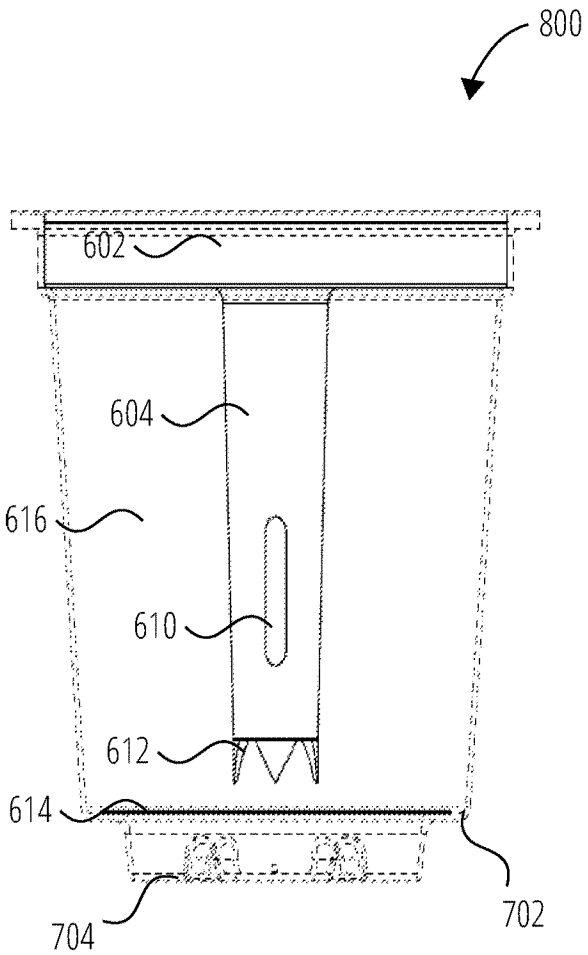
FIG. 8 illustrates a left view of the internal architecture for the milk cartridge of FIG. 1, according to some examples.
Figure 7:
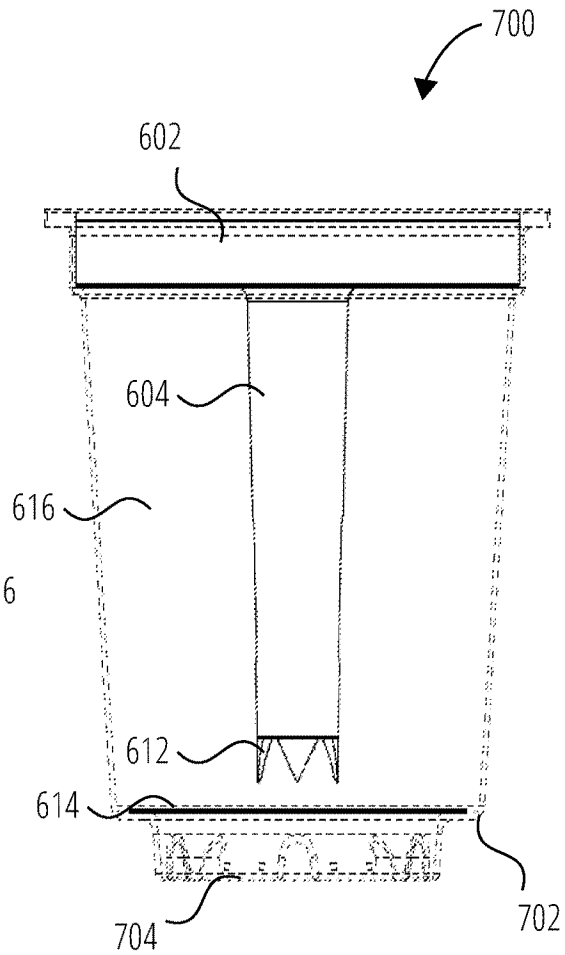
FIG. 7 illustrates a front view of the internal architecture for the milk cartridge of FIG. 1, according to some examples.
Figure 6:
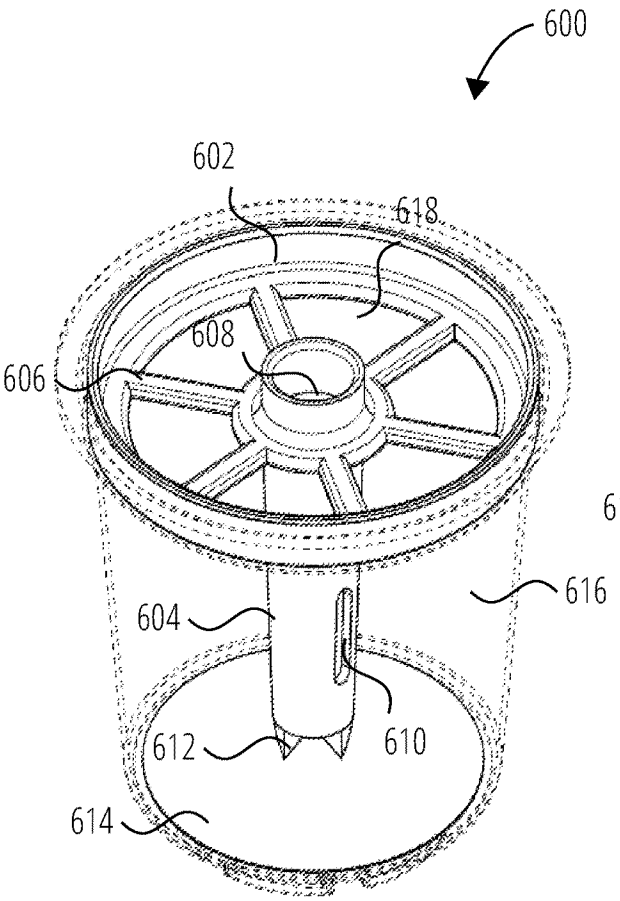
FIG. 6 illustrates a perspective view of the internal architecture for the milk cartridge of FIG. 1, according to some examples.
Figure 10:
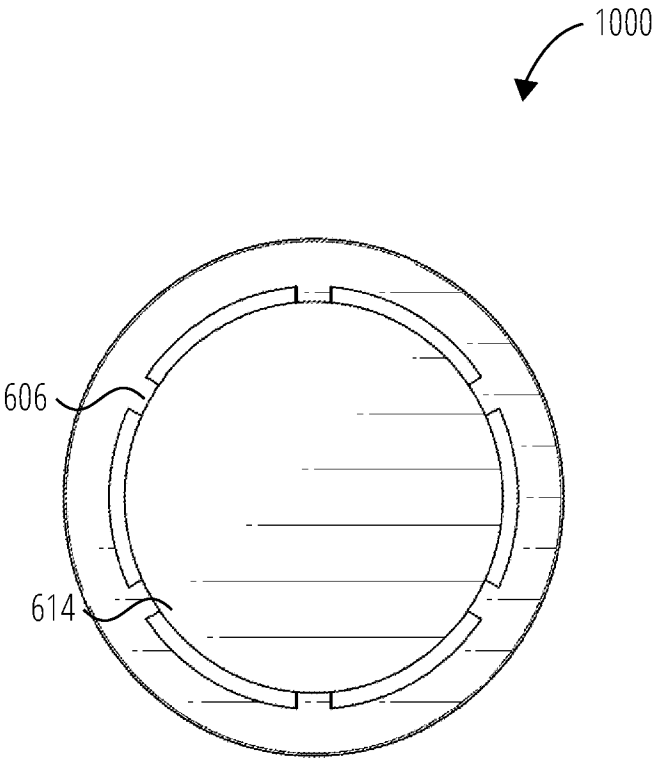
FIG. 10 illustrates a bottom view of the internal architecture for the milk cartridge of FIG. 1, according to some examples.
Figure 9:
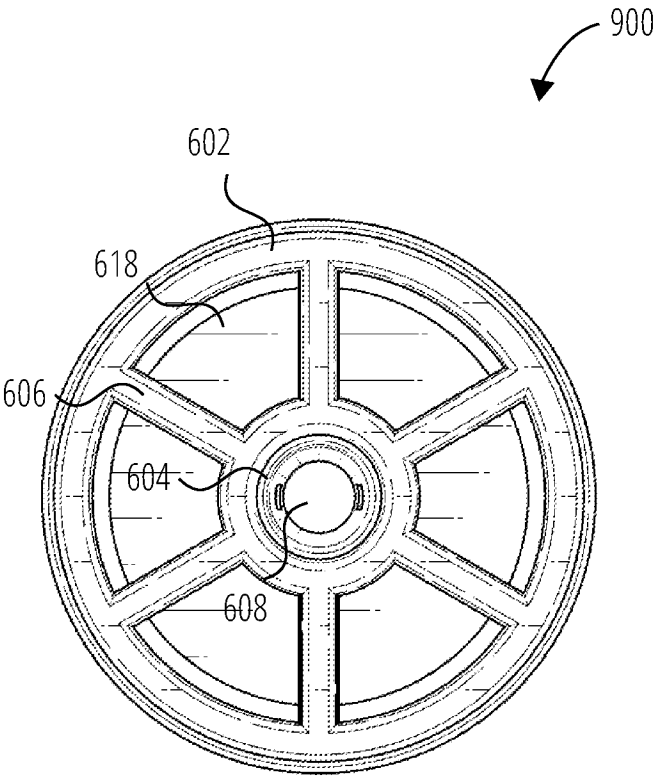
FIG. 9 illustrates a top view of the internal architecture for the milk cartridge of FIG. 1, according to some examples.
Figure 11:
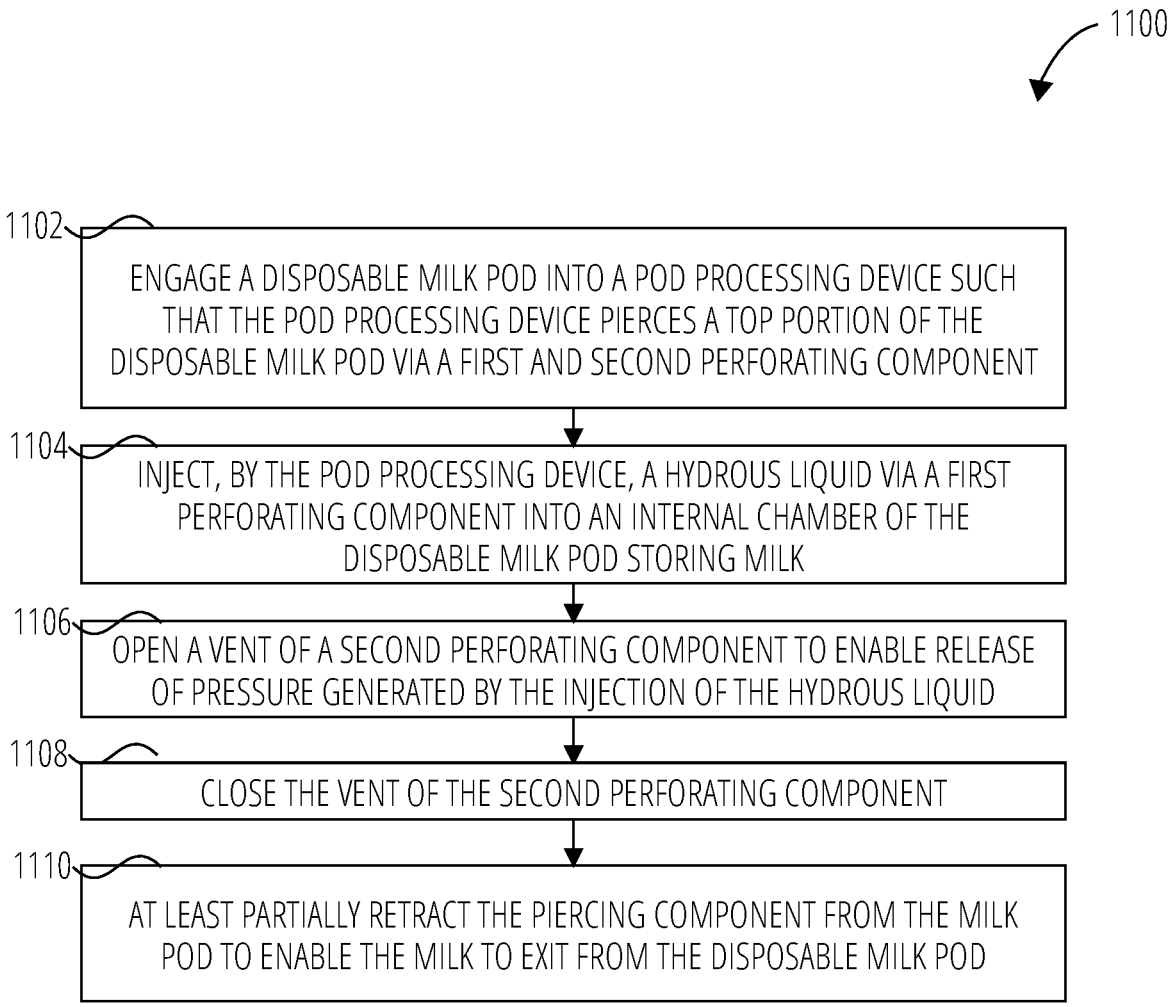
FIG. 11 illustrates a flowchart for processing a disposable milk pod in a pod processing device, according to some examples.

FIG. 6 illustrates a perspective view 600 of the internal architecture for the milk cartridge of FIG. 1, according to some examples. FIG. 7 illustrates a front view 700 of the internal architecture for the milk cartridge of FIG. 1, according to some examples. FIG. 8 illustrates a left view 800 of the internal architecture for the milk cartridge of FIG. 1, according to some examples. FIG. 9 illustrates a top view 900 of the internal architecture for the milk cartridge of FIG. 1, according to some examples. FIG. 10 illustrates a bottom view 1000 of the internal architecture for the milk cartridge of FIG. 1, according to some examples. FIGS. 9-10 are shown without the external architecture of the milk cartridge. FIG. 11 illustrates a flowchart 1100 for processing a disposable milk pod in a pod processing device, according to some examples.

Although the examples described herein are explained with specific features, such as slits, cylinders, chambers, and/or the like, it is appreciated that when alternatives for a particular feature are disclosed, these alternatives (such as the number of slits or orifices being circular) can apply to examples discussing the particular feature (such as examples describing slits), and vice versa.

Although the example flowchart 1100 depicts a particular sequence of operations, the sequence may be altered without departing from the scope of the present disclosure. For example, some of the operations depicted may be performed in parallel or in a different sequence that does not materially affect the function of the flowchart 1100. In other examples, different components of an example device or system that implements the flowchart 1100 may perform functions at substantially the same time or in a specific sequence.

FIG. 6 illustrates a cartridge 616 that includes an internal structure 602 below the top barrier at the top portion of the pod. This internal structure 602 is responsible for allowing the hydrous liquid, such as water or steam, to enter the internal chamber 608 containing the milk and for perforating a bottom membrane of the cartridge to allow steamed liquid to exit the chamber. The internal structure could also allow air to enter the internal chamber to froth, but not heat, the milk or other liquid inside the chamber.

At operation 1102, the disposable milk pod is engaged into the pod processing device. When the milk pod is placed into a compatible pod processing device, the device pierces the top film barrier and interacts with the internal structure 602. This piercing is the first step in initiating the process of injecting hydrous liquid into the milk pod, which is crucial for heating and frothing the milk contained within. The perforating component serves as a connection between the pod processing device and the internal chamber of the milk pod, facilitating the introduction of hydrous liquid for mixing with the milk. In some cases, a single perforating component can perform the functions of the perforating components described herein, such as described in FIG. 20 and corresponding paragraphs.

At operation 1104, the pod processing device injects a hydrous liquid or air via a first perforating component into an internal chamber of the disposable milk pod storing milk. The internal structure 602 within the milk pod features an internal channel 608 and a conduit 604 (such as a center cylinder) that extends through the radial center of the pod.

The center conduit 604 serves as a channel for hydrous liquid (e.g., water or steam) or even air to be injected from the pod processing machine into the milk pod. For the sake of simplicity, examples can describe the center conduit 604 as the cylinder, tube, and/or the like, but it is appreciated that features described for one architecture applies to the other, and vice versa. This central location of the conduit allows the hydrous liquid to be evenly dispersed within the milk chamber and permits the steam or hydrous liquid to be introduced into a lower area of the pod, below the fill line, allowing for consistent heating and frothing of the milk. However, the conduit need not be in a central location within the pod.

In some cases, the conduit 604 does not extend all the way to the bottom of the pod, leaving some space between the conduit's end and the pod's bottom surface. The conduit's termination before reaching the bottom of the pod can help maintain the integrity of the pod's structure and prevent leaks or other potential issues during pod storage or transportation.

In some cases, the internal structure 602 is of a different shape. For example, the internal structure 602 can include a cone-shaped structure with a base at the top portion of the milk pod, tapering down towards the bottom, where the bottom portion of the internal structure 602 pierces the top barrier 1206 of the milk pod first. This option could potentially provide better mixing and aeration of the milk, as the shape might facilitate a swirling motion when hydrous liquid is introduced into the pod.

The internal channel includes an opening within the conduit such that the hydrous liquid or air can travel through the conduit from the pod processing device and into a chamber of the pod.

In some cases, a rectangular prism is used, with its long sides aligned vertically. This architecture could offer better support to the internal structure 602 and create a more stable structure. The internal channel 608 and one or more orifices 610 could be adapted to fit the rectangular prism design. Moreover, such an architecture can prevent rotational movement of the pod.

The internal structure 602 can include a helical or spiral structure could be used as the center component, potentially promoting better mixing and aeration of the milk when the hydrous liquid is introduced into the pod.

In some cases, instead of having the center cylinder extend axially and/or radially down the milk pod, the cylinder could be offset from the center, allowing for a different flow pattern when the hydrous liquid is introduced. This configuration could influence the mixing and aeration of the milk. The center channel can also include a flanged disc or other dispersion mechanism for distributing the fluid radially outwardly from the center chamber. For example, orifices 610 can be located at the end of a horizontal channel spaced apart from the center conduit 604 so that the openings are located more towards the sides of the chamber.

In some cases, the center cylinder could be shorter, not extending as far down the milk pod and the milk level. This design could create a larger chamber for milk storage.

In some cases, the center cylinder could be replaced with an external guiding structure, combined with the perforating component, that directs the hydrous liquid from the pod processing machine into the milk pod. This design could simplify the internal structure 602 of the milk pod, potentially making it easier to manufacture. The mixing and aeration of the milk would occur as fluid is introduced into the pod, relying on the flow pattern created by the external guiding structure. In some cases, the pod does not include a central cylinder and/or the vent, such as if frothing of the milk is not required. In some cases, the pod would only include a piercing component.

The external guiding structure can incorporate one or more features of the internal structure 602 and perform one or more similar functions. For example, the external guiding structure can be a part of the pod processing device, where the external guiding structure includes a center conduit 604, a vent, and/or a piercing component 612. The external guiding structure can pierce the top barrier using the piercing component 612 and can be extended into the milk chamber where steam is injected into the milk using the center conduit 604 which enters into the milk pod from the radial center. The vent can be a separate perforating component piercing the top barrier at a different location (such as between the arms 618) to enable venting of built-up pressure, and the same piercing component 612 can later be used to pierce the bottom barrier 614 after frothing of the milk is complete to allow exiting of the milk.

In some cases, the center cylinder extends all the way down to the bottom of the milk pod. This configuration could provide more stability to the internal structure 602. In some cases, a center cylinder includes an adjustable length, allowing the cylinder to extend further down the milk pod or be retracted based on user preferences or the desired aeration and mixing process. The pod can include a mechanism, such as a sliding bar on the pod and/or one of the perforating components of the pod processing device.

In the milk pod, the internal structure 602 can include one or more arms extending radially from the center cylinder to the wall portion of the pod, such as arm 606. These arms maintain the stability and structural integrity of the internal structure 602 and the milk pod as a whole. By connecting the center cylinder to the pod walls, the arms help ensure that the cylinder remains in its proper shape and position during storage, transportation, and the milk processing stages. The radial arms 606 also reinforce the pod's overall structure, making it more resistant to damage or deformation during handling, storage, and usage.

All or a portion of one or more arms can be made of a flexible material, such as flexible relative to other material of the pod, so that the center cylinder can be pressed towards the bottom of the chamber. While the center cylinder is pressed, the anchoring ring remains fixed near the top of the chamber. This movement is facilitated by the flexibility of the flexible material of the one or more arms. As such, when an external force is applied to press the center cylinder downward, the flexible portion of the arms allows for this movement.

In such an arrangement, the top portion of the internal structure 602 can be fixed to the inside of the cup and the center conduit 604 can be pressed downward from the top by an external device. The portion of the arms 606, made of a relatively flexible material allows the center conduit 604 to move downward. Likewise, the arms can also be hinged or other mechanism to allow movement of the center conduit 604 when pressed downward.

In some cases, the internal structure 602 applies other types of architectures to hold the center cylinder in place. The center cylinder could be held by arms that extend toward the top or the bottom portions, or at an angle from a radial extension, extending toward the top or extending toward the bottom portion of the pod.

The center cylinder could be held in place by a surrounding mesh structure that connects the cylinder to the wall portion of the milk pod. This mesh structure would provide support and stability to the center cylinder while still allowing hydrous liquid to flow around it and mix with the milk. The center cylinder could be held in place via a series of interlocking rings that encircle the cylinder and connect it to the wall portion of the milk pod. These rings could be evenly spaced along the length of the cylinder, or a single continuous spiral support that the center cylinder to the wall portion of the milk pod.

The center cylinder of the internal structure 602 in the milk pod has an internal channel 608 that serves as a pathway for hydrous liquid to flow from the pod processing machine into the pod. This internal channel 608 is designed to provide a direct and efficient route for the liquid to enter the milk pod and facilitate the mixing process and to allow the hydrous liquid or air to be introduced below the surface of the milk or other liquid in the pod.

When the milk pod is engaged with the pod processing machine, the machine punctures the barrier on the top portion of the pod and injects a hydrous liquid, steam or air into the internal channel 608 of the center cylinder. The fluid (such as the hydrous liquid) then travels through the channel and exits through one or more orifices 610 defined in the internal structure 602 into the milk chamber, where the hydrous liquid mixes with the milk, other liquid or powder contained inside.

In some cases, the internal structure 602 injects the fluid via an external channel system of the pod processing device, such as a channel separate from the central cylinder. This external channel can directly inject the fluid into the milk chamber. In some cases, the perforating component is retracted after piercing the pod and a separate external channel is inserted to inject the fluid.

In some cases, the center cylinder can be made of a porous material that allows the hydrous liquid to pass through and enter the milk chamber. The pores could be distributed evenly throughout the cylinder or concentrated in specific areas, depending on the desired mixing effect.

In some cases, a perforated tube could replace or supplement the center cylinder, with small holes distributed along the length of the tube. When the pod processing machine injects fluid into the tube, the fluid can flow through these holes into the liquid in the chamber. The size and distribution of the holes could be adjusted to control the flow rate and mixing effect.

The center cylinder of the internal structure 602 in the milk pod features one or more orifices 610 designed to enable the hydrous liquid, which is sent from the pod processing machine, to mix with the milk contained within the internal chamber of the pod. This orifice serves as an exit point for the hydrous liquid that flows through the internal channel 608 of the center cylinder and enters the milk chamber.

When the hydrous liquid passes through the one or more orifices 610, it creates a jet of air, steam or liquid that mixes with the milk in the internal chamber, promoting the desired frothing and aeration of the milk.

In some cases, other openings can be used to inject the hydrous liquid into the milk chamber. For example, small nozzles could be integrated into the center cylinder. These nozzles could create a spray or jet-like effect when the hydrous liquid is injected, promoting better mixing with the milk. The number, size, and angle of the nozzles could be adjusted to control the mixing and aeration.

In some cases, a mesh or screen could be placed at the point where the internal channel 608 meets the milk chamber. The hydrous liquid can pass through the mesh or screen, breaking up the liquid flow into smaller droplets, which would then mix with the milk. The mesh or screen could have different hole sizes and patterns to influence the mixing effect.

The design and positioning of the one or more orifices can 610 play a role in achieving the optimal blending of hydrous liquid and milk, which ultimately affects the texture and quality of the final milk-based beverage.

The one or more orifices 610 in the center cylinder can be configured as slits, such as two slits, one on each side of the cylinder. These slits serve as exit points for the hydrous liquid that flows through the internal channel 608 of the center cylinder and enters the milk chamber, allowing the liquid to mix with the milk. The one or more orifices 610 in the center cylinder can also be configured as round, rectangular or other shaped openings. In some cases, one or more of the orifices 610 are angled creating a swirling effect when the steam exits into the milk chamber further enhancing the frothing effect. In some cases, one or more deflectors are added on the side wall of the pod such that when the milk and/or steam swirl within the milk chamber, the swirling pattern is modified when deflecting off the one or more deflectors causing further frothing.

The use of two or more orifices, as opposed to a single opening, can have several advantages. First, two or more orifices can create a more even distribution of the hydrous liquid as it enters the milk chamber, promoting more consistent mixing and frothing of the milk. Second, having two or more orifices can increase the overall flow rate of the hydrous liquid, which can impact the speed and efficiency of the milk pod processing.

With two or more orifices, the design ensures that the hydrous liquid and milk mix effectively, resulting in a well-aerated and frothy milk-based beverage. The multi-orifice configuration can be a factor in achieving the desired texture and quality of the final drink, enhancing the user's experience and satisfaction.

In some cases, the one or more orifices 610 are of different shapes than slits. The center cylinder can have circular holes on each side or around the circumference of the cylinder. The orifice shape can be triangular, with one or more triangle-shaped openings on each side of the cylinder or around the circumference. Cross-shaped orifices can be used as an alternative to slits, which could create more turbulence and better mixing of the fluid with the milk or other liquid or powder inside the chamber.

In some cases, the internal structure 602 can include a single orifice that can simply the design and potentially reduces manufacturing costs. Moreover, a single orifice provides a single, focused stream of hydrous liquid to mix with the milk, allowing for controlled aeration.

In some cases, the milk pod allows users or pod manufacturers to customize the number of orifices to control the aeration and frothing of the milk. Manufacturers can create milk pods with any number of orifices and users can purchase a milk pod for the type of drink the user desires. Users can choose to have more orifices for a frothier milk or fewer slits for a smoother, less aerated milk. This offers flexibility and personalization based on individual preferences.

In the milk pod design, the size of the orifice(s) in the center cylinder can be customized to be large or small, depending on the desired level of aeration in the milk and/or the type of liquid used in the pod. For example, sugared creamers may respond better to differently-shaped and sized orifices than plain milk. In addition, the size and shapes of the orifices can vary on the same center cylinder with larger or differently shaped openings toward the bottom and smaller openings at the top or vice versa. Manufacturers can create milk pods with an orifice size and users can purchase a milk pod for the type of drink the user desires. This customizable feature allows users or pod manufacturers to achieve different textures and levels of frothiness in their milk-based beverages according to their preferences.

A larger orifice (or lengthened orifice) could result in a higher flow rate of the hydrous liquid entering the milk chamber, which can introduce more air into the milk, creating a frothier and airier texture. This can be particularly useful for drinks like cappuccinos or lattes that require a significant amount of froth. Likewise, the number or shape of the orifices could also affect the flow rate which could change the frothing characteristics of the product.

On the other hand, a smaller orifice could result in a lower flow rate of the hydrous liquid, leading to a gentler mixing process with less aeration. This may be preferable for drinks that require a smoother and creamier milk texture, like a flat white or a simple hot chocolate.

By offering a variety of orifice sizes, the milk pod design enables users or pod designers to customize their milk-based beverages to suit the type of liquid in the pod as well as personal tastes and preferences. In a reusable pod, the reusable pod can include an adjustable orifice design enabling a user to vary the size of the orifice. The adjustable mechanism can include a slidable or rotatable mechanism to adjust the size of the opening (e.g., sliding a lever or rotating a dial to widen or narrow the orifice), a clicking or locking mechanism, and/or the like.

The design of the milk pod allows for the one or more orifices 610, which is responsible for enabling hydrous liquid to enter and mix with the milk, to be placed at different heights within the center cylinder. The orifice can be situated above, in the middle of, or underneath the milk level depending on the desired mixing intensity. This flexibility in placement allows for different mixing behaviors and levels of aeration, depending on the desired outcome for the milk-based beverage being prepared.

When the orifice is placed above the milk level, the hydrous liquid will be introduced into the milk chamber from the top, potentially creating a more gentle mixing process. This positioning may be suitable for beverages requiring a smoother, less aerated milk texture, such as a hot chocolate or a flat white. Although examples described herein describe the steam frothing the milk, it is appreciated that other types of alterations are included, such as altering the amount of aeration of the milk or temperature of the milk. Moreover, adjusting the orifices can cause such other types of alterations.

With the orifice in the middle of the milk level, the hydrous liquid will be introduced directly into the milk, potentially resulting in a more thorough mixing process. This can lead to a moderately aerated milk texture, which may be suitable for drinks where a balance between smoothness and frothiness is desired.

When the orifice is positioned underneath the milk level, the hydrous liquid may be introduced from the bottom of the milk chamber, which can lead to a more vigorous mixing process and higher levels of aeration. This placement may be ideal for beverages that require a frothy and airy milk texture.

The ability to position the orifice at different levels within the milk chamber provides users or pod manufacturers with greater control over the mixing process and the final texture of their milk-based beverages, allowing users to enjoy a customized drinking experience. For example, manufacturers can manufacture milk pods with orifices at different levels and users can purchase the milk pods for the type of drinks they want.

The milk pod design shown in FIG. 6 also includes a piercing component 612 situated at the bottom of the internal structure 602. This component enables the flow of the prepared milk out of the pod and into the user's cup. The piercing component 612 features pointed elements that are designed to pierce through a bottom barrier 614 holding the milk inside the pod.

The bottom barrier 614 can be fixed to the sides of the pod or it can rest on an indent on the pod, such as a shelf 702. The shelf and the bottom barrier 614 can be of a larger diameter than the bottom wall 704 of the pod, enabling the bottom barrier 614 to be supported by the shelf while having distance to the bottom wall. This advantageously makes manufacturing of the bottom barrier 614 far easier, as well as providing some error of margin for the piercing component 612 to pierce just the bottom barrier 614 and not the bottom wall of the pod.

Before engagement with the pod processing device, the piercing component 612 remains in a resting position, hovering above the bottom barrier 614. By keeping the barrier intact until engagement with the pod processing device, the milk pod ensures that the milk remains securely contained within the pod during storage, transportation, and handling. This prevents leaks, spills, or contamination, thereby maintaining the freshness and quality of the milk until it is ready to be used in the preparation of a milk-based beverage.

Once the pod is engaged with the processing device as described in more detail below, the piercing component 612 is activated, allowing for the efficient and controlled release of the milk-based beverage. When the milk pod is inserted into the pod processing device and engaged, the piercing component 612 is activated and punctures the bottom barrier 614 that kept the milk contained within the pod. This action creates an opening through which the mixed and aerated milk can flow out of the pod and into the user's cup. In some cases, the piercing component 612 does not puncture the bottom barrier until the milk in the chamber is fully frothed. In other cases, the piercing component 612 only punctures the bottom barrier a certain amount and completes the full puncture as the milk is getting frothed or is fully frothed.

In some cases, the piercing component 612 and the bottom barrier 614 for liquid to exit are located in a different portion of the milk pod. For example, the piercing component 612 can be disposed on the side of the milk pod, near the bottom, which would allow milk to flow out through a side channel when the pod is engaged with the processing device. In some cases, the piercing component 612 is integrated with the internal structure 602 underneath the film barrier at the top portion to allow milk to flow out of the top portion of the pod when engaged with the processing device. The advantage of this design is that it consolidates the inflow and outflow mechanisms in one location (such as a top portion), potentially simplifying the manufacturing process.

In some cases, the piercing component 612 includes a sliding piercing component that can move between a resting position and an engaged position when the milk pod is inserted into the processing device. When engaged by a component of the processing device, such as the piercing component or guiding structure, the sliding piercing component can puncture the milk barrier to allow milk to flow out. This design adds a level of flexibility to the milk pod, potentially allowing for better compatibility with various processing devices.

In some cases, the piercing component 612 then engages the bottom barrier to enable the milk to flow out either before, during, or after frothing of the milk.

In some cases, the top barrier and the bottom barrier 614 are made of different materials. For example, the bottom barrier 614 can comprise a weaker substance than the top barrier, such that the pod processing device more easily pierces the bottom barrier 614 with reduced risk of having the top barrier burst. This difference in materials can also apply to functions related to pressure. For example, the bottom barrier 614 can be designed to burst via pressure if sufficient pressure is introduced into the pod. This pressurization method would eliminate the need for piercing element 612.

Engaging Milk Pod with Pod Processing Device

In the embodiment shown in FIG. 6, before the milk pod is engaged with the pod processing device, the piercing component, which is located at the bottom of the internal structure, rests above the bottom barrier. This positioning is important for preserving the integrity of the milk pod and maintaining the freshness and quality of the milk inside.

By having the piercing component rest above the bottom barrier prior to engagement, the milk pod prevents the barrier from being accidentally punctured during handling, storage, or transportation. This architecture helps to ensure that the milk remains securely contained within the pod, avoiding leaks, spills, or contamination, thereby maintaining its freshness until it is ready to be used in the preparation of a milk-based beverage.

Figure 12:
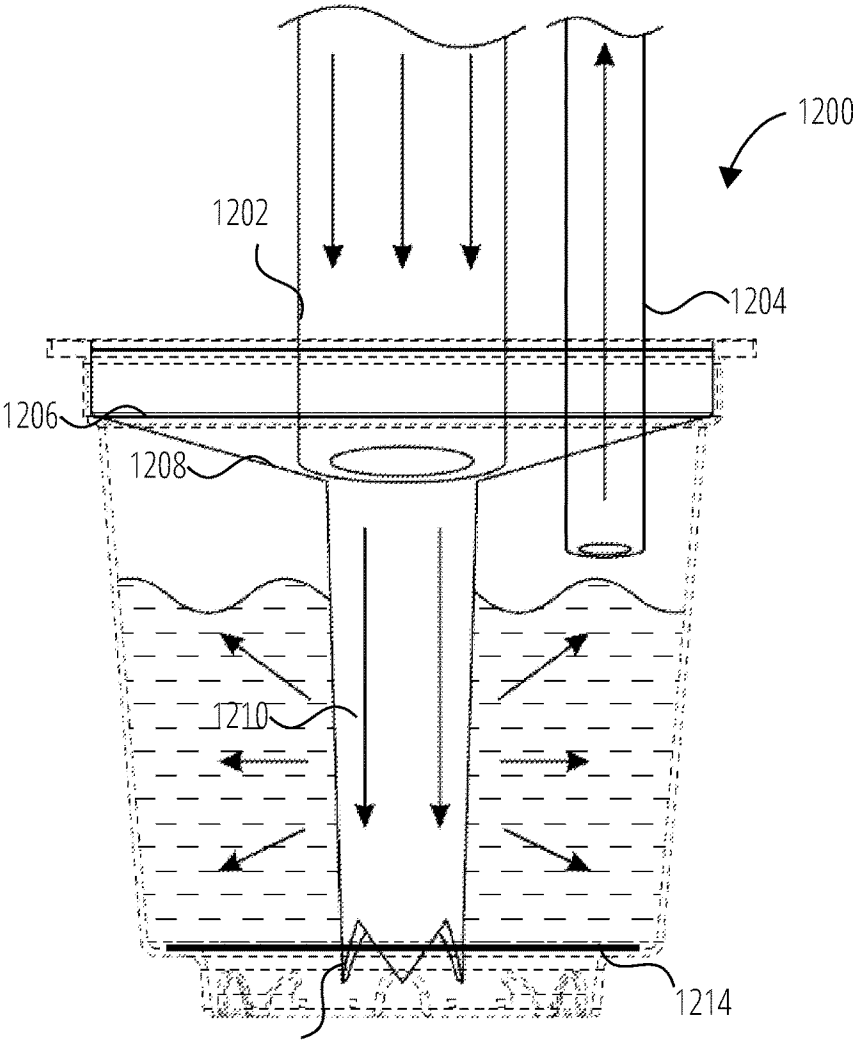
FIG. 12 illustrates a milk pod engaging with the pod processing device to mix hydrous liquid with milk, according to some examples.

FIG. 12 illustrates a milk pod 1200 engaging with the pod processing device to mix hydrous liquid with milk, according to some examples. As explained before, although the examples discussed herein refer to milk as the substance in the pod, any liquid (e.g., milk, cream, creamer) or dry (e.g., ground coffee, powdered creamer) material can be used in the pods in connection with the embodiments described herein. The piercing component 1212 is designed with pointed features that allow it to puncture the bottom barrier 1214 when the milk pod is placed into the pod processing device and the pod processing device closes, whereby the closing of the pod processing device presses the first perforating component into the cylinder. This piercing action creates an opening for the milk to flow out of the bottom of the pod after being mixed and aerated with the hydrous liquid from the processing machine.

In some cases, the piercing component 1212 serves as both the mechanism to puncture the bottom barrier 1214 and a temporary seal to allow mixing of the hydrous liquid with the milk before milk is allowed to exit from the bottom barrier 1214.

The milk pod is placed into the pod processing machine, and a first perforating component 1202 of the pod processing machine pierces a top barrier 1206. The perforating component presses down onto the center conduit 1210 causing the center conduit 1210 to be pushed toward the bottom portion of the pod. The radial arms 1208 are flexed and/or angled in response to the pressure generated by the perforating component while still maintaining structural integrity of the central center conduit 1210 and the pod.

The piercing component 1212 of the milk pod pierces a bottom barrier 1214, creating an opening for the milk to exit. However, the piercing component 1212 can also remain inside the pierced hole, partially or wholly sealing at least part of the hole, preventing or reducing the amount of the milk exiting the pod at this stage.

The pod processing machine sends hydrous liquid through the internal channel of the center cylinder, where the fluid mixes with the milk in the internal chamber via the orifices present in the center cylinder. The hydrous liquid mixes with the milk inside the chamber, creating the desired froth or aeration depending on the size and configuration of the orifices.

At operation 1106, the pod processing device opens a vent of a second perforating component to enable release of pressure generated by the injection of the hydrous liquid. In some examples, the pod processing machine further includes a second perforating component 1204 also piercing the top barrier 1206. The second perforating component 1204 enables pressure generated by the injection of the hydrous liquid to be released via the second perforating component 1204. In some cases, air is injected into the second perforating component to enhance frothing of the milk and/or to force evacuation of any remaining fluid in the pod out of the exit holes.

In the example of FIG. 12, the first perforating component 1202 pierces a radial center of the barrier, and the second perforating component 1204 pierces off center of the pod. However, it is appreciated that the first and/or the second perforating components can pierce the pod in different locations. For example, the second perforating component can pierce the center of the top barrier 1206 whereas the first perforating component 1202 can pierce off center of the bottom barrier 1214.

In some examples, the first perforating component 1202 is a separate perforating component than the second perforating component 1204, such as the perforating components 1202 and 1204, piercing different portions of the top barrier 1206. In other examples, the perforating component that pierces the top barrier 1206 injects the hydrous liquid and releases the pressure from within the pod. For example, the perforating component can include an internal channel that injects the hydrous liquid and another internal channel that releases the pressure.

In some examples, the first and/or second perforating component include a gasket surrounding a circumference of the perforating component. The gasket helps to seal the space between the pierced barrier and the perforating component, preventing or reducing hydrous and/or air leaks from within the pod. In some cases, the gasket is sized to surround the perforating component, such as a threshold thickness extending from the circumference of the perforating component.

In some cases, the gasket is sized to be of a certain radius of the top portion of the milk pod. For example, the gasket can be of the same diameter as the top barrier or a portion of the diameter of the top barrier. In some cases, the gasket can cover the top barrier and a portion of the side wall.

At operation 1108, the pod processing device closes the vent of the second perforating component to enable pressure to build up from within the pod. The vent can be closed in one of several different ways. The vent can be equipped with a mechanical valve that can be manually operated to open or close it. This can be in the form of a lever, knob, or switch that allows the user or the pod processing device to control the position of the valve and seal or open the vent as needed.

A solenoid valve can be employed to control the opening and closing of the vent. A solenoid is an electromechanical device that, when energized, can actuate the valve to open or close. This can be controlled electronically, allowing for automated vent closure based on predetermined conditions or user input.

The vent can be designed with a pressure-activated valve that automatically closes when a certain pressure level is reached inside the milk pod. Once the steam pressure generated during the frothing process reaches a specific threshold, it triggers the valve to close, preventing further release of steam and frothed milk.

A bi-metallic strip can be utilized as a temperature-sensitive closure mechanism for the vent. The strip is made of two different metals with different thermal expansion rates. As the temperature rises due to the steam injection, the strip bends and causes the vent to close, effectively sealing it.

A spring-loaded mechanism can be employed to close the vent. The spring applies pressure to keep the vent closed, and when activated or released, it allows the vent to open for the release of steam and frothed milk. This mechanism can be manually operated or automated, depending on the design and functionality requirements.

The vent closure can be controlled by smart sensors that monitor specific parameters such as temperature, pressure, or flow rate. Based on the sensor readings, the system can automatically determine when to close the vent, ensuring optimal frothing conditions and preventing any excessive steam or milk release.

Figure 13:
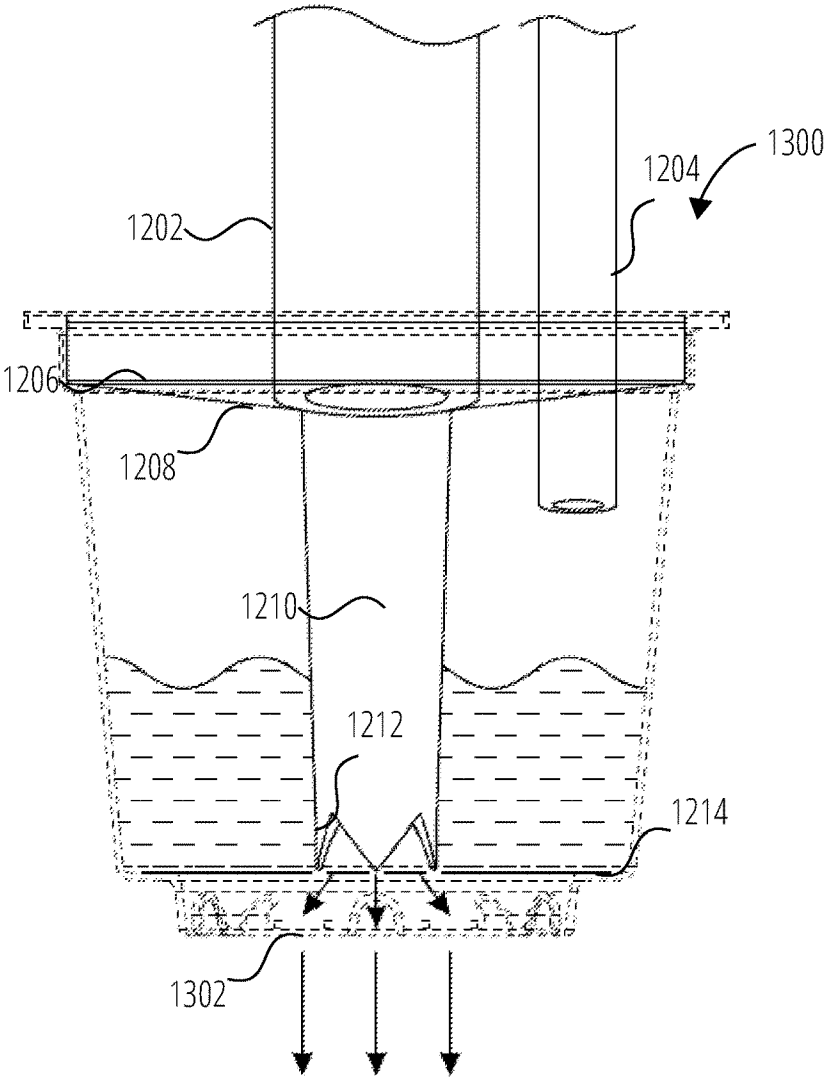
FIG. 13 illustrates the perforating component retracting from the pod to enable exit of the milk, according to some examples.

At operation 1110, the pod processing device at least partially retracts the piercing element to further open the pierced barrier and to enable the milk to exit from the disposable milk pod. FIG. 13 illustrates the perforating component partially retracting from the pod 1300 to enable exit of the milk, according to some examples. Once the mixing process is complete, the pod processing machine can slightly retract the perforating components, such as the first perforating component 1202 and the second perforating component 1204, which in turn moves the central center conduit 1210 and the piercing component 1212 upward and out of the hole it created in the bottom barrier 1214. The radial arms 1208 can also be less flexed and/or angled in response to a reduction of pressure generated by the retracting of one or more perforating components. For example, the pod processing device can partially retract to still maintain a hold on the pod while creating the opening for the milk to exit.

With the piercing component 1212 no longer blocking the hole on the bottom barrier, the milk mixture can more easily flow out of the pod. This design feature provides better control over the mixing process, allowing for the creation of an ideal milk froth or aeration before the milk exits the pod. By using the piercing component 1212 as a temporary seal, the mixing process can be optimized before the milk is released into the cup.

Moreover in FIG. 13, the second perforating component 1204 is no longer open but blocks at least a portion of the airflow back out of the pod. As such, pressure can build within the pod, enabling the milk to exit from the bottom of the pod. In some cases when the second perforating component 1204 is no longer open, the first perforating component 1202 applies more pressure to the internal structure, pressing the piercing components further into the bottom barrier and effectively creating a larger hole. In some cases, the opening of the holes in the bottom barrier 1214 from the retracted perforating component 1202 causes the milk to naturally flow down and out of the milk pod.

When the mixing and/or aeration process is complete, a valve in the second piercing element can be fully or partially closed. This will prevent the steam or hydrous liquid from being vented through the second piercing element and will cause pressure to build within the pod. The increased pressure within the pod will cause the liquid product within the pod to be more forcefully ejected through the holes in the bottom of the pod. The timing and degree of the valve closure can be chosen to optimize the quality of the ejected liquid. For example, the valve can be only partially closed in order to regulate the pressure in the pod. Alternatively, the valve can be closed earlier or later depending on the desired pressure during the mixing process.

In some examples, upon engaging the pod to the pod processing device, the perforating component injects hydrous liquid without applying pressure to the central center conduit 1210 and/or without enough pressure to engage the piercing component 1212 onto the bottom barrier and thus maintaining the seal on the bottom barrier. After the milk has been frothed, the pod processing device can apply the pressure needed to engage the piercing component 1212 onto the bottom barrier, enabling exit of the milk.

In some cases, the pod has one or more holes, such as hole 1302, at the bottom of the pod. The size of the holes can enable further frothing of the milk upon exiting the pod and into a user's cup. Smaller holes create a higher resistance for the frothed milk to flow through, which can result in increased pressure inside the milk pod. This increased pressure can cause the milk and steam to mix more thoroughly, leading to a denser and creamier froth. Moreover, as the frothed milk is forced through the smaller holes, the shear force generated can further break down the milk bubbles, creating an even finer and smoother froth.

Larger holes provide less resistance to the flow of frothed milk, which can lead to a lighter and airier froth. Since the pressure inside the milk pod is lower compared to smaller holes, the milk and steam may not mix as intensely, resulting in larger bubbles and a less dense froth. This can be desirable for beverages that require a lighter froth, such as a latte.

In some cases, the perforating component and corresponding conduit can be aligned such that the pod is punctured in a different location than the radial center. For example, the perforating component to inject the hydrous liquid can puncture an off-center of the top barrier 1206, a portion of the wall, and/or a portion of the bottom. The perforating component to release pressure can pierce the pod at a different location than the perforating component that injects the hydrous liquid. In some cases, the milk can exit the pod at a different location than the bottom of the pod, such as the top or side of the pod.

In some cases, the pod processing device can pierce a different type of milk container. For example, a plastic bottle, a milk carton made of paperboard or paper-based materials, a glass bottle with non-glass pierceable portions, milk bags (such as a mylar bag), milk pods or capsules, tetra paks, and/or the like can store milk and the pod processing device can pierce such containers. For example, for a mylar bag, a piercing component can pierce a top or side portion. In some cases, the mylar bag has a flat bottom portion whereby the milk can exit, such as by holes pierced by the pod processing device or by pressure pushing milk out of small holes at the bottom.

In some cases, different types of pressure can be exerted into the milk pod. For example, a different steam pressure can be applied based on the desired type of drink by the user. In some cases, the steam pressure can be different based on a sequence. Initially, steam is applied to the milk pod to heat the milk inside. The steam transfers heat to the milk, raising its temperature to the desired level for warm or hot milk.

After heating, the steam pressure is adjusted to a specific level suitable for frothing the milk. Frothing involves introducing air into the milk, creating a creamy and frothy texture. This is typically done by directing steam into the milk, creating small bubbles and increasing its volume.

Once the desired frothiness is achieved, the vent or opening in the milk pod is closed. This prevents the escape of steam and restricts the air from escaping, allowing the frothed milk to maintain its texture and consistency. With the vent closed, the steam pressure is further increased. The increased pressure helps facilitate the exit of milk from the milk pod. The pressure forces the milk out of the pod through a specific outlet or channel, ready for dispensing into a cup or container.

This process allows for the preparation of warm or hot milk, frothed milk, and controlled milk dispensing from a milk pod. By adjusting the steam pressure at different stages, the desired texture and consistency can be achieved, whether it is warm milk for a latte, frothed milk for a cappuccino, or any other milk-based beverage.

In some cases, the pod includes baby formula within one or more chambers. Similar to one or more features of the milk pod, the baby formula pod can apply features to baby milk formula stored within the baby formula pod for delivering pre-measured portions of infant formula for preparing baby bottles.

The pod processing device can inject water at a particular temperature into a chamber of the baby milk formula pod storing the baby milk formula. The baby milk formula can be in powder or liquid form. The baby milk formula pod may not require steam injection, but instead water at a specific temperature suitable for the baby's consumption.

In some cases, a venting mechanism may or may not be applied to the baby milk formula pod. The injection of water can create pressure from within the baby milk formula, and a perforating component can enable steam to escape from the baby formula pod.

In some cases, the holes in the baby milk formula pod are used for allowing the prepared formula to flow into a baby bottle, facilitating feeding. In some cases, the one or more holes in the baby milk formula pod can be shaped to enable formula to escape directly into the baby bottle. For example, the holes can be created such that the combination of holes does not exceed a certain diameter (such as a diameter of the baby bottle). In some cases, the pod processing machine applies a heater or boiler configured to heat the water to a certain temperature, such as 98 degrees. Water can flow into the heater or boiler, increase in temperature, and flow into another conduit into the pod interface to inject into the baby formula pod.

Punctured Bottom Wall of the Pod

Figure 14:
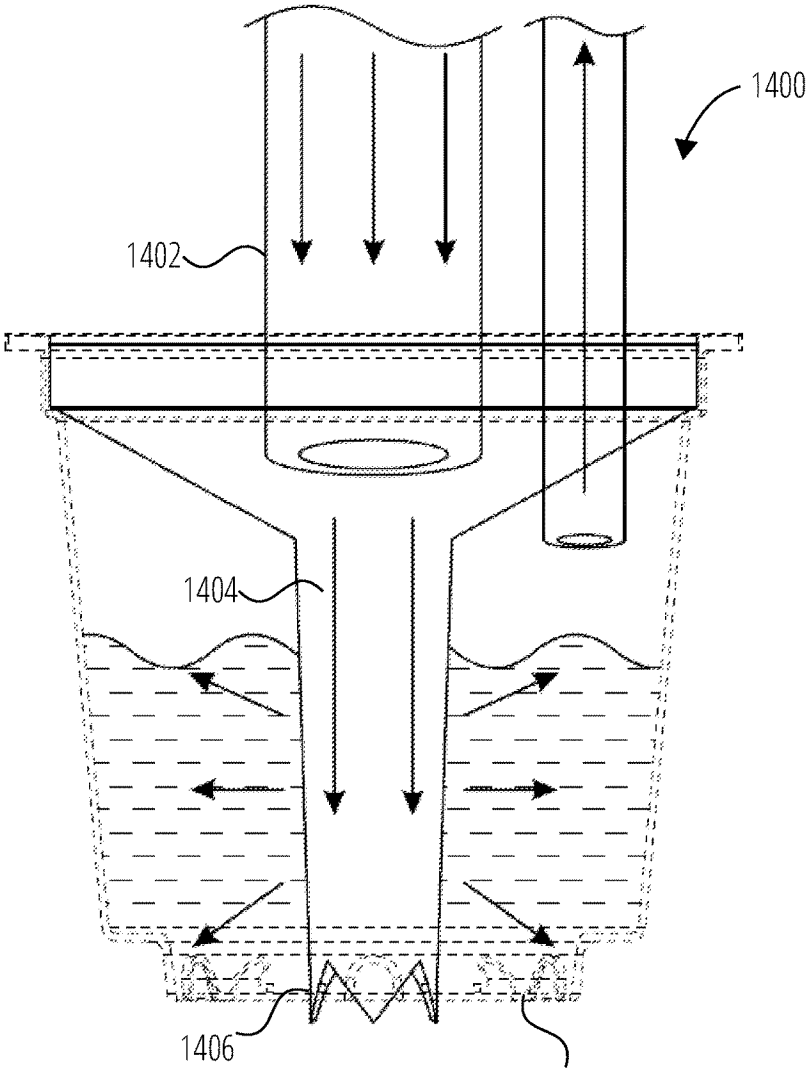
FIG. 14 illustrates the internal structure puncturing a bottom wall of the pod, according to some examples.

FIG. 14 illustrates the internal structure puncturing a bottom wall of the pod 1400, according to some examples. In an alternative design for the milk pod, the bottom barrier is removed, and the piercing component is used to puncture the bottom wall of the pod directly.

The milk pod is placed into the pod processing machine, and the machine's perforating component 1402 engages with the internal structure 1404 of the pod, including the piercing component 1406. As the perforating component pushes the internal structure 1404 downward, the piercing component 1406 punctures the bottom wall 1408 of the milk pod, creating an opening for the milk to exit. However, the piercing component 1406 remains inside the hole, effectively sealing it, and preventing or reducing the milk from exiting the pod at this stage. In some cases, the bottom wall 1408 is made from a pierceable barrier.

Simultaneously, the pod processing machine sends hydrous liquid through the internal channel of the center cylinder, entering the milk chamber via the orifices present in the cylinder. The hydrous liquid mixes with the milk inside the chamber, creating the desired froth or aeration depending on the size and configuration of the orifices.

Once the mixing process is complete, the pod processing machine slightly retracts the perforating component 1402, which in turn moves the internal structure 1404 and the piercing component 1406 upward and out of the hole created in the bottom wall 1408. With the piercing component 1406 no longer blocking the hole, the milk mixture can now flow out of the pod.

This alternative design simplifies the structure of the milk pod and reduces the number of components by removing the bottom barrier and/or replacing the bottom wall 1408 with the bottom barrier. By utilizing the piercing component 1406 to both create and temporarily seal the hole in the bottom wall 1408, the milk pod can still achieve optimal frothing and aeration before the milk exits the pod.

In some cases, the pressure from injecting the hydrous liquid itself creates an opening on a wall portion of the milk pod to enable the milk to exit from the pod. For example, at least a portion of the bottom layer of the pod can be made from a different material (weaker) than the side walls. Thus, the pressure generated by the first perforating component 1402 can create an opening in the bottom wall 1408 made of a different material without a piercing component 1406. In some cases, certain portions of the bottom layer are made of a different material that is less resistant to temperature. As such when the temperature of the pod or milk reaches a certain temperature, the material is compromised and the milk is allowed to exit from the pod.

In some cases, instead of holes at the bottom, the milk pod includes other exit channels for milk to exit. For example, the milk pod can include straw slots or straw holes with multiple blades. These blades are designed to provide a convenient opening for pushing milk out of the milk pod once pressure builds up within the pod (e.g., by closing the vent).

The blades can be evenly spaced around the center of the channel, forming four slits or channels. Each blade can be configured to be slightly angled or curved after pressure is applied to accommodate for exiting of the milk. When pressure is exerted, the blades flex or bend slightly to create a channel for the milk to flow out of the milk pod.

Milk and Coffee Pod with Single Central Conduit

Figure 15:
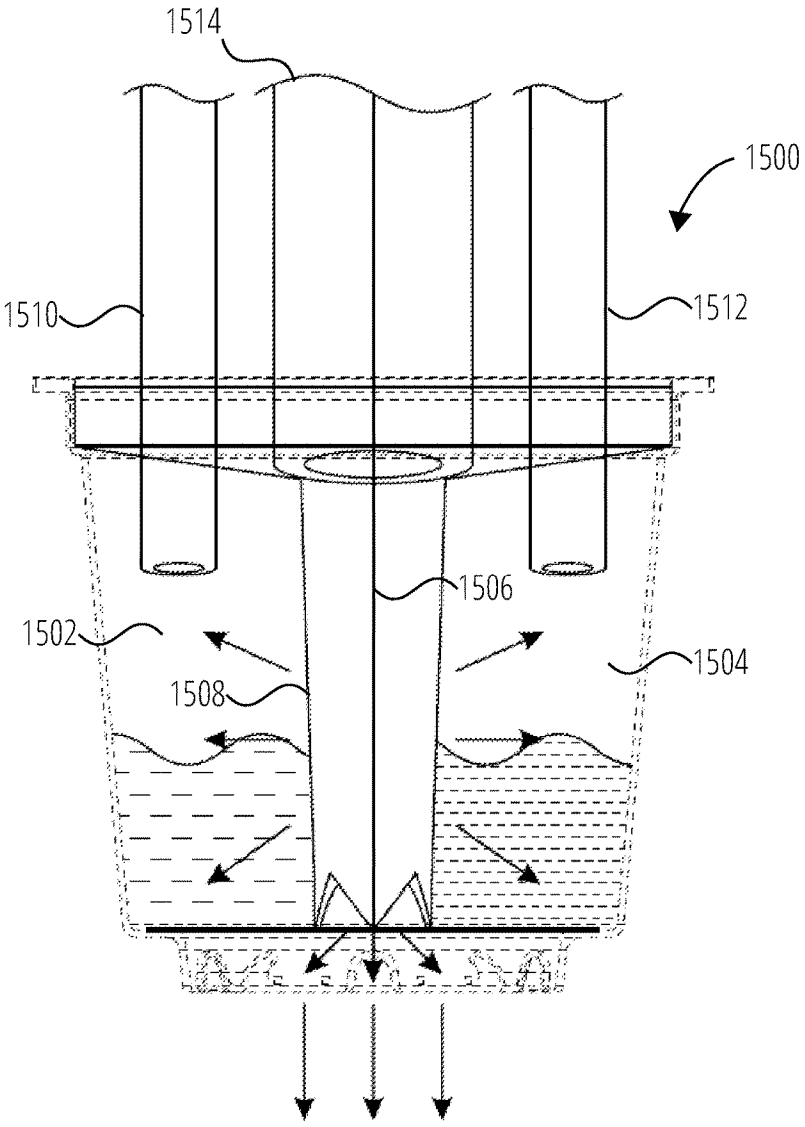
FIG. 15 illustrates a milk and coffee pod with individual vents, according to some examples.

FIG. 15 illustrates a milk and coffee pod 1500, according to some examples. In this alternative design for the pod, the pod includes both a milk chamber 1502 and a coffee chamber 1504 separated by a center wall 1506. The center cylinder 1508 is split into two chambers, with one side injecting steam into the milk chamber 1502 for frothing and the other side injecting hot water into the coffee chamber 1504 for brewing. The size of each chamber can be chosen based on the type and amount of the products in each chamber.

The milk pod is placed into the pod processing machine, and the machine's first perforating component 1514 engages with the internal structure of the pod, including the center cylinder 1508. The center cylinder 1508 is divided into two separate channels: one for steam to froth the milk and another for hot water to brew the coffee.

As the first perforating component 1514 pushes the internal structure downward, the piercing component punctures the bottom barrier, creating separate openings for both the milk and the coffee to exit. The pod processing machine sends steam through one half of the center cylinder's internal channel, entering the milk chamber 1502 via the orifices present in the center cylinder 1508. The steam mixes with the milk inside the milk chamber 1502, creating the desired froth or aeration depending on the size and configuration of the orifices.

Simultaneously or subsequently, the pod processing machine sends hot water through the other half of the center cylinder's internal channel, entering the coffee chamber 1504 and mixing with the coffee grounds for brewing. Both the steam and hot water are injected at a controlled rate and pressure to ensure optimal frothing of the milk and brewing of the coffee.

Once the frothing and brewing processes are complete, the milk and coffee mixtures can flow out of their respective openings created by the piercing component. The milk and coffee mixtures can be combined in the cup to create the desired beverage, such as a latte or cappuccino.

This alternative design provides a convenient way to simultaneously froth milk and brew coffee within a single pod, streamlining the process for users and allowing for the creation of various specialty coffee beverages with ease.

In some examples, the pod is inserted into the pod processing device in different configurations. For example, in one configuration, the pod processing device can inject steam for the milk chamber 1502. Then the pod is removed and inserted again in another configuration, and the pod processing device can inject hot water for the coffee chamber 1504. The configurations can be labeled or mechanically structured to be fitted into a particular configuration, such as a depression or bulge.

In the example of FIG. 15, the pod is pierced by a second perforating component 1510 and a third perforating component 1512. The second perforating component 1510 enables pressure to be released from the milk chamber 1502, and the third perforating component 1512 enables pressure to be released from the coffee chamber 1504.

The difference between various drinks often lies in the proportion of frothed milk, microfoam, and espresso. A latte typically includes of a shot of espresso, frothed milk, and a small layer of microfoam on top. The higher ratio of milk to espresso creates a creamy, smooth, and balanced drink. A cappuccino has equal parts of espresso, frothed milk, and microfoam, resulting in a richer coffee flavor and a more pronounced foam layer compared to a latte. A macchiato is an espresso shot with a small dollop of frothed milk or microfoam on top. It has a more intense coffee flavor due to the minimal milk content. A flat white is similar to a latte but uses a double shot of espresso and a smaller amount of frothed milk with a thin layer of microfoam. This creates a stronger coffee flavor with a velvety texture.

Steam and milk work together to create an array of coffee drinks with different textures, flavors, and mouthfeels, providing a diverse range of options for coffee lovers to enjoy. As such, pod manufacturers can generate pods with the right proportion of milk and coffee to generate various drink types.

In some cases, a filter can be added to the chamber to filter the substance stored in the chamber before exiting from the pod. For example, a coffee filter can be added to the coffee chamber 1504. The coffee filter can align with at least a portion of the internal wall of the pod. For example, the coffee filter can run along at least a portion of the bottom wall, the shelf, and/or the side wall.

In some cases, a portion of the milk pod can include a first chamber and a second chamber. The first chamber can include one type of substance such as one type of dairy product (e.g., milk) whereas the other chamber holds another type of substance, such as another type of dairy product (e.g., creamer).

Milk and Coffee Pod with Individual Central Conduits

Figure 16:
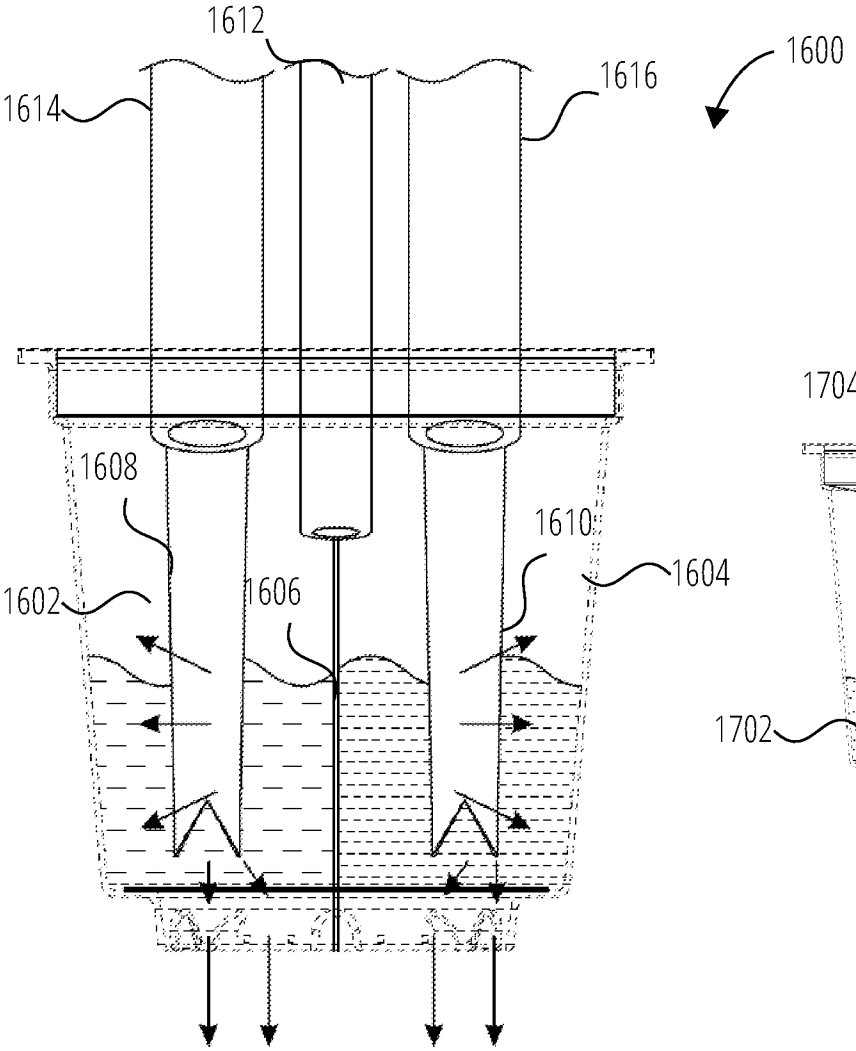
FIG. 16 illustrates a milk and coffee pod with individual central conduits, according to some examples.

FIG. 16 illustrates a milk and coffee pod with individual central conduits 1600, according to some examples. In this alternative design for the pod, the pod includes both a milk chamber 1602 and a coffee chamber 1604 separated by a center wall 1606. The pod processing device injects steam into a first center cylinder 1608 via a first perforating component 1614 and ultimately into the milk chamber 1602 for frothing. The pod processing device injects hot water into a second center cylinder 1610 via a second perforating component 1616 and ultimately into the coffee chamber 1604 for brewing. Additionally, there is a third perforating component 1612 to release steam, which can be located in the center or along the separation of the pod or as separate perforating components for each chamber.

The milk pod is placed into the pod processing machine, and the machine's perforating components engage with the internal structure of the pod, including the two center cylinders, positioned centrally between the radial center of the pod and the wall of the pod. The first center cylinder 1608 is designed to inject steam into the milk chamber 1602 for frothing. The second center cylinder 1610 is designed to inject hot water into the coffee chamber 1604 for brewing.

As the perforating components push the center cylinders downward, the piercing components puncture the bottom barrier, creating separate openings for both the milk and the coffee to exit.

The pod processing machine sends steam through the first center cylinder's internal channel, entering the milk chamber 1602 via the orifices present in the cylinder. The steam mixes with the milk inside the chamber, creating the desired froth or aeration depending on the size and configuration of the orifices.

Simultaneously, prior to, or subsequently, the pod processing machine sends hot water through the second center cylinder's internal channel, entering the coffee chamber 1604 and mixing with the coffee grounds for brewing.

The third perforating component 1612, which can be located in the center or as separate components for each chamber, releases steam as needed during the frothing and brewing processes.

Both the steam and hot water are injected by a pump at a controlled rate, temperature and pressure to ensure optimal frothing of the milk and brewing of the coffee. Once the frothing and brewing processes are complete, the milk and coffee mixtures can flow out of their respective openings created by the piercing component and into the user's cup. The milk and coffee mixtures can be combined in the cup to create the desired beverage, such as a latte or cappuccino.

This alternative design provides a convenient way to simultaneously froth milk and brew coffee within a single pod, streamlining the process for users and allowing for the creation of various specialty coffee beverages with ease. The addition of the third perforating component 1612 further enhances the control and efficiency of the steam release during the process.

Powder Milk Pods

Figure 17:
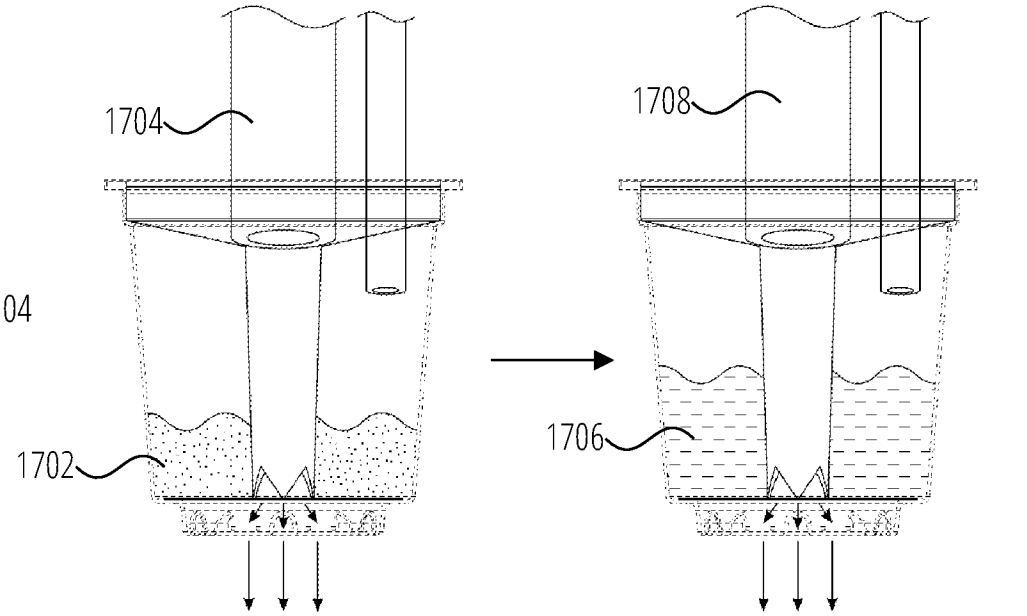
FIG. 17 illustrates pods with powdered milk, according to some examples.

FIG. 17 illustrates pods with powdered milk 1700, according to some examples. In this design for the milk pod, the milk is initially in powder form 1702 inside the pod. The pod processing device first injects water 1704 to dissolve the milk powder into liquid milk 1706, and then introduces steam 1708 to froth the milk.

The milk pod, containing milk powder, is placed into the pod processing machine. The machine's perforating component engages with the internal structure of the pod, including the center cylinder. As the perforating component pushes the internal structure downward, the piercing component punctures the bottom barrier, creating an opening for the milk to exit once it has been mixed with water and frothed.

The pod processing machine sends water through the internal channel of the center cylinder, entering the milk chamber via the orifices present in the cylinder. The water mixes with the milk powder inside the chamber, dissolving it and creating liquid milk.

Once the milk powder has been dissolved, the pod processing machine introduces steam through the same internal channel in the center cylinder. The steam enters the milk chamber via the orifices present in the cylinder. The steam mixes with the liquid milk, creating the desired froth or aeration depending on the size and configuration of the orifices.

Both the water and steam are injected at a controlled rate and pressure to ensure optimal dissolution of the milk powder and frothing of the liquid milk. Once the dissolution and frothing processes are complete, the liquid milk mixture can flow out of the opening created by the piercing component and into the user's cup. The milk froth can then be combined with coffee or other ingredients to create the desired beverage.

This design provides a convenient way to use milk powder within a single pod, simplifying the process for users and allowing for the creation of various milk-based beverages. By first dissolving the milk powder with water and then introducing steam, the milk pod ensures an optimal frothing process that results in a creamy and aerated milk froth.

Figure 18:
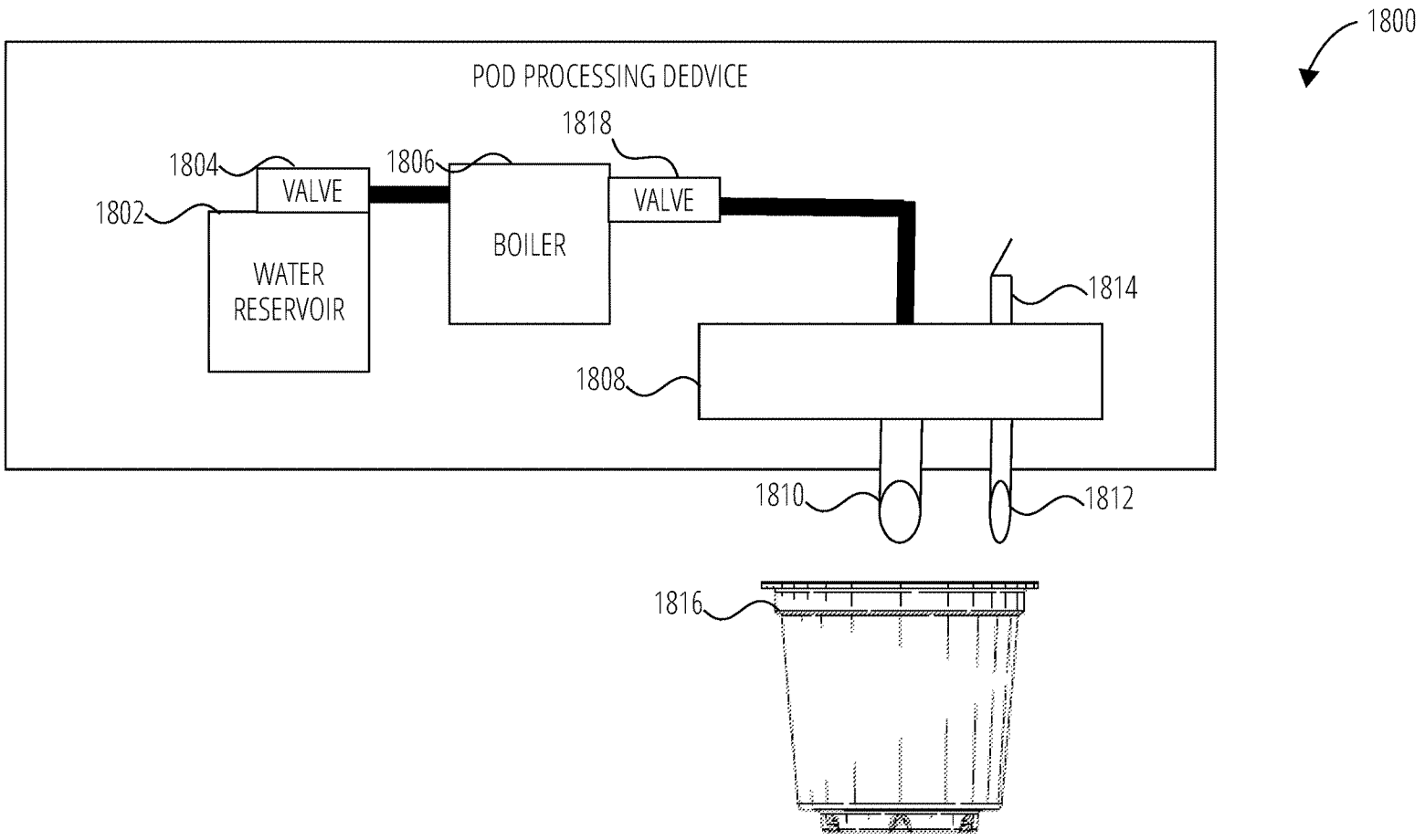
FIG. 18 illustrates an architecture for a pod processing device, according to some examples.

FIG. 18 illustrates a schematic architecture 1800 for a pod processing device, according to some examples. In this example, the pod processing device includes a water reservoir 1802, a valve 1804, a boiler 1806, a first perforating component 1810, a first end 1812 of a second perforating component, a second end 1814 of the second perforating component, and a pod interface 1808. In some cases, the pod processing device includes an opening for the boiler, such as instead of a separate water reservoir, to enable a user to add water directly into the boiler through a removable lid or cap. In some cases, a valve 1818 is included to the output of the boiler to control the volume and/or duration of the steam being sent to the pod. In some cases, the boiler 1806 is connected with the pod via two separate channels, one for the steam and another for hot water. In some cases, a second boiler is used such that a first boiler provides steam and a second boiler provides hot water.

The water reservoir 1802 is a component of the pod processing device that holds a certain amount of water for use in the milk pod processing cycle. The water reservoir 1802 serves as a source of water that will be heated and injected into the disposable milk pod. The water reservoir includes a lid or opening that allows the user to pour water into it easily. The reservoir may also have a maximum fill line to prevent overfilling and ensure proper operation.

Once the water is added to the water reservoir 1802, the pod processing device can be ready to be used in the pod processing cycle. The valve 1804, controlled by the pod processing device, regulates the flow of water from the reservoir to other components of the device. This valve can be opened or closed as needed during the milk pod processing cycle to control the water flow rate and timing. The valve regulates the amount and timing of water that is released from the water reservoir and directed towards the boiler for heating. A pump (not shown) can be used to facilitate the transport of the fluid from the reservoir to the boiler and/or from the boiler to the milk pod.

In an automated system, both the pump and the valve can be controlled by electronic or mechanical means. This allows for precise control and automation of the water flow, ensuring consistent and accurate processing of the milk pod.

The valve can work in conjunction with other components of the device, such as sensors or timers, to achieve the desired water flow rate, temperature and timing. For example, sensors can be used to monitor water levels in the reservoir or detect the presence of a milk pod, triggering the valve to open or close accordingly. The valve can also be controlled in response to a temperature in the boiler and/or the temperature in the pod interface 1808.

The water from the water reservoir 1802 is then directed towards the boiler 1806, where it is heated to its boiling point. The boiler is responsible for heating the water to the desired temperature, typically the boiling point or beyond, for the purpose of creating steam. In the coffee pod examples above, the boiler can be set to heat the water to the proper coffee brewing temperature, which can be measured using a temperature sensor that is connected to a microprocessor or other computing device that controls the operation of components of the pod processing device.

The boiler 1806 is designed to heat the water rapidly and efficiently, ensuring that the water reaches the required temperature for the extraction process. The boiler 1806 may utilize various heating mechanisms, such as electrical heating elements or gas burners, depending on the specific design of the pod processing device.

The boiled water or steam is subsequently injected into the disposable milk pod through the first perforating component 1514, which pierces the pod's outer layer to allow the water or steam to enter. When the pod processing cycle is initiated, water from the water reservoir is directed into the boiler through the controlled flow of the valve. The boiler then heats the water, converting the water into steam or maintaining it at a high temperature.

By reaching the boiling point or generating steam, the heated water and/or steam generated by the boiler becomes an effective medium for extracting the milk from the milk pod. The high temperature helps to dissolve and release the milk components from the pod, resulting in a flavorful and aromatic beverage.

As explained in some of the examples above, the boiled water or steam can be then injected into the disposable milk pod through the first perforating component 1810, which pierces the pod's outer layer to allow the hot water or steam to enter and mix with the milk ingredients. The amount of heated water or steam and the pressure created by the injection are controlled to ensure proper extraction.

The second perforating component with a first end 1812 pierces the pod and a second end 1814 can selectively release the pressure built up inside the pod during the injection of the boiled water and/or steam. This helps in relieving any excess pressure and ensures the safe handling of the used milk pod. This also allows the fluid in the pod to be heated or frothed without creating pressure in the pod that expels the liquid through the holes in the bottom of the pod.

The pod interface 1808 serves to hold the one or more perforating components in place as the perforating components pierce the milk pod. The pod interface 1808 enables the engagement and interaction between the disposable milk pod and the device itself. The pod interface 1808 serves as the connection point where the pod is inserted and secured during the milk extraction process. The pod processing device can alternatively be used with any of the pod embodiments discussed above.

The design of the pod interface can vary depending on the specific device, but can include a slot or compartment that is specifically designed to accommodate the shape and size of the disposable milk pod. The interface is typically located in a designated area of the pod processing device, easily accessible for pod insertion and removal.

The pod interface 1808 is designed to securely hold the milk pod in place during the processing cycle, ensuring that the pod remains in the correct position for efficient milk extraction. This may involve mechanisms such as latches, clips, or magnetic connectors to keep the pod in place and prevent any accidental dislodging or movement during operation.

In addition to providing physical support, the pod interface 1808 also facilitates sealing and communication between the pod and the rest of the device. This communication can involve various components and sensors within the interface that detect and interpret information from the milk pod. For example, the interface may have sensors to detect the presence of a pod, read information encoded on the pod, or determine the type of beverage to be prepared.

In some cases, the pod can include a code, such as a QR code, RFID or bar code, on the pod. The pod processing device can scan the code to determine the contents of the pod. The pod processing device can gather information on optimal water, steam, temperature, and/or the like for the particular pod. For example, the right combination for powdered formula may be to heat water to 98 degrees (or some other temperature) and send the water through the perforating component into the milk chamber, then to let the mixture mix for 30 seconds before enabling the mixture to exit from the bottom of the pod. In another example, the pod processing device can determine for coffee to send steam for 10 seconds, then 12 oz of water at a particular rate to maximize extraction. In other cases for foamed milk, the pod processing device can steam the milk for 30 seconds and then shut the pressure release valve to increase the foaminess from within the pod.

In some cases, the code is linked to a database of configurations for the pod. For example, the code is linked to when, how, and for how long the pod processing device opens the valves, heats the hydrous liquid to a particular temperature, injects mixtures of water, steam, and/or air, and/or the like. The code is linked to a particular type of pod and the pod processing device retrieves instructions on how to prepare the particular pod.

In some cases, the pod processing machine is connected to the internet. The pod processing machine can retrieve the configurations from the pod based on accessing an external database and providing information corresponding to the scanned code. Advantageously, the pod processing machine can retrieve the most up-to-date configurations for preparing a particular type of pod. In some cases, a user can select a particular type of configuration or a preference for his or her beverage, such as the amount of froth. The configurations retrieved based on the scanned code can be custom tailored toward the preference of the user.

In some cases, the pod processing machine can link a type of pod, instructions for a pod, instructions for a particular drink, or other characteristics of the pod, contents of the pod, or instructions for the pod processing device based on the pod itself. For example, the milk pods can be equipped with unique QR codes or barcodes that are linked to specific information about the type of milk, such as the fat content, flavor, or type of milk. The pod processing device can have a built-in scanner or camera to read the QR code or barcode and identify the milk pod accordingly.

In some cases, the milk pods can be embedded with RFID tags containing identification data. The pod processing device can have an RFID reader to detect and read the information stored in the RFID tags. This allows for automatic identification of the milk pod when it is engaged with the pod processing device. In some cases, the RFID tags can be added as a separate tag or printed directly onto the pod, such as the top seal portion.

The pod processing device can be equipped with a camera or optical sensor to capture an image of the milk pod. Through image processing and recognition algorithms, the device can analyze the visual features or patterns on the pod to identify the type of milk pod.

The milk pods can be designed with unique magnetic or sensor patterns that can be detected by corresponding sensors in the pod processing device. These patterns could be read and matched against a database to determine the specific type of milk pod.

Milk pods can be integrated with NFC technology, allowing the pod processing device to communicate with the pod wirelessly. By tapping or bringing the milk pod close to the NFC reader on the device, information about the milk type can be transmitted and identified.

The pod processing device can have sensors to measure the weight, volume, or shape of the milk pod when it is engaged with the device. Different types of milk pods may have varying weights, volumes, or shapes, allowing the pod processing device to identify the specific type based on these measurements.

Once the milk pod is engaged with the pod interface 1808, the pod processing device can then initiate the necessary actions, such as opening the valve 1804 to control water flow, activating the boiler 1806 to heat the water, and operating the perforating components to pierce the pod and inject the boiled water, air and/or steam.

Figure 19:
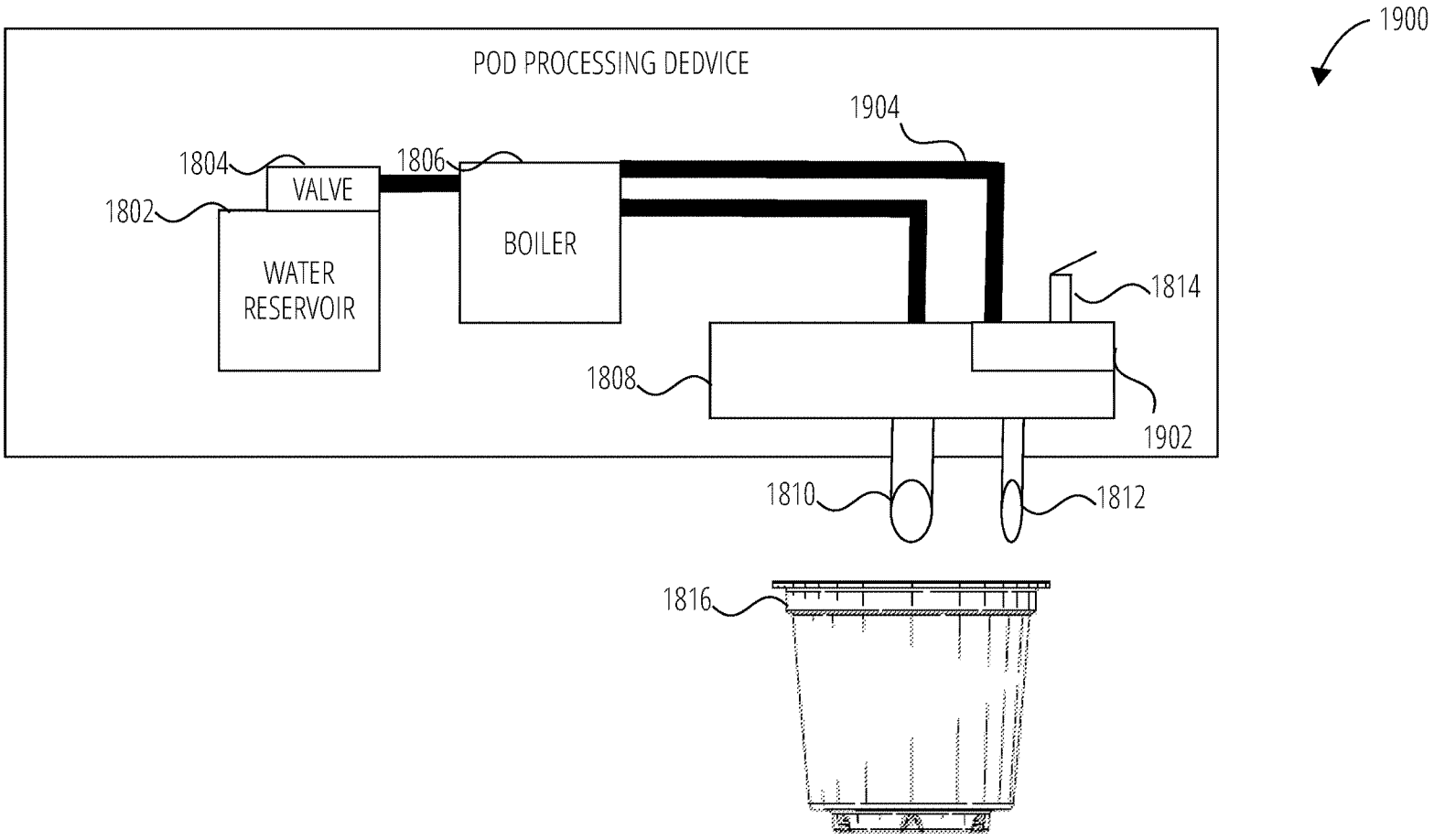
FIG. 19 illustrates an architecture for switching the vent to either the boiler or external environment, according to some examples.

FIG. 19 illustrates an architecture 1900 for switching the vent to either the boiler or external environment, according to some examples. In some cases, the pod processing device includes a switchable two-way valve 1902. For example, the valve 1902 can be a part of the pod interface 1808. In one configuration, the valve can guide steam or fluid from the boiler 1806 to the pod 1816 via a channel 1904. In another configuration, the valve can vent pressure from the first end 1812 of the vent externally through the second end 1814 of the vent and outside the machine.

Figure 20:
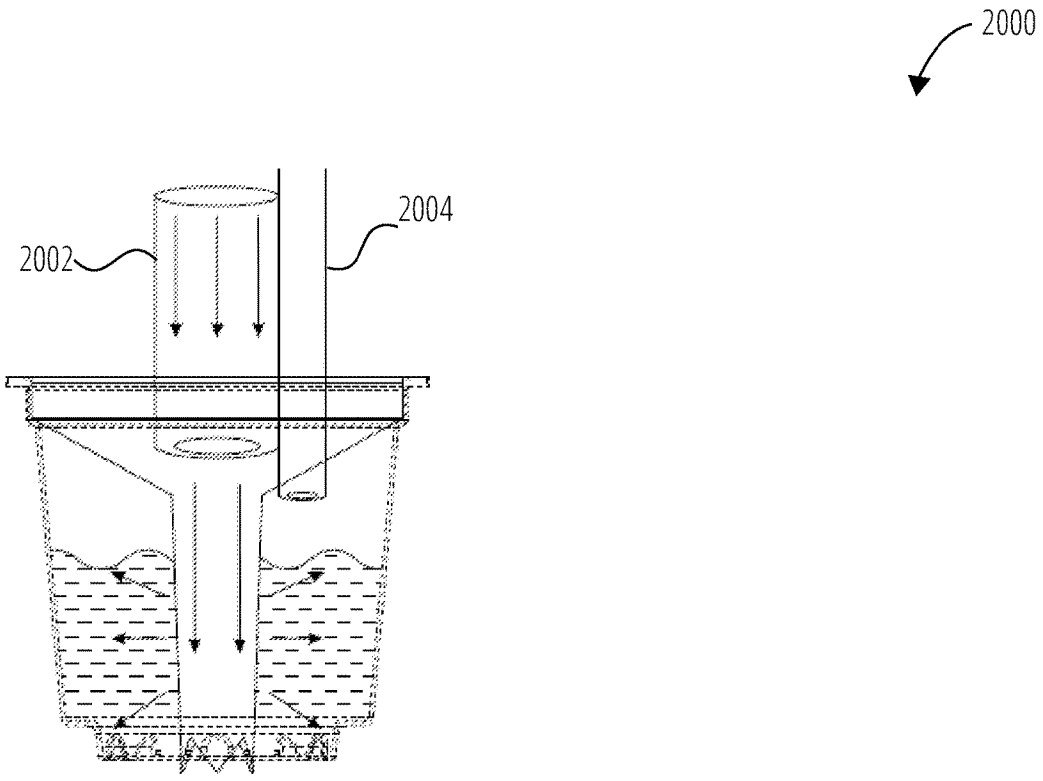
FIG. 20 illustrates an architecture for the milk pod where the vent and steam insert is connected, according to some examples.

FIG. 20 illustrates an architecture 2000 for the milk pod where the vent and steam insert are connected, according to some examples. The steam perforating component 2002 can be connected to the vent perforating component 2004. In some cases, the steam perforating component 2002 extends further into the pod than the vent perforating component 2004, and/or vice versa. In some cases, the steam perforating component 2002 is wider in diameter or length than the vent perforating component 2004, and/or vice versa. In some cases, the vent perforating component 2004 is in the shape of a cylinder connected with the vent perforating component 2004 that is at least partially in the shape of a cylinder.

In some cases, the steam perforating component 2002 and the vent perforating component 2004 are connected in such a way that the steam perforating component 2002 inserts steam through an inner channel of the perforating component, and the vent perforating component 2004 releases pressure via an outer concentric area of the inner channel, and/or vice versa. For example, the steam perforating component 2002 can include a channel that is within half of the diameter from the perforating component's center, and the vent perforating component 2004 includes a channel that surrounds the channel for the steam perforating component 2002, where the vent channel is between half-diameter and full-diameter of the perforating component, and/or vice versa. The steam perforating component 2002 and the vent channel can be concentric tubes sharing the same center (e.g., an axis extending from a center point of the diameter at the top of the pod to the bottom portion of the pod).

EXAMPLES

In view of the above-described implementations of subject matter this application discloses the following list of examples, wherein one feature of an example in isolation or more than one feature of an example, taken in combination and, optionally, in combination with one or more features of one or more further examples are further examples also falling within the disclosure of this application.

Example 1 is a disposable milk pod comprising: an internal chamber containing milk; a bottom portion; a top portion, wherein the top portion comprises a first barrier; a wall portion connecting the bottom and top portions, wherein prior to the disposable milk pod engaging with a pod processing device, the first barrier, the bottom portion, and the wall portion seal the milk within the internal chamber; and a conduit, wherein in response to the disposable milk pod engaging with the pod processing device, the pod processing device pierces one or more portions of the first barrier and injects a hydrous liquid into the internal chamber via the conduit, such that the milk mixes with the hydrous liquid.

In Example 2, the subject matter of Example 1 includes, wherein the conduit is located within the internal chamber, wherein during engagement of the disposable milk pod with the pod processing device, the pod processing device pierces the first barrier via a perforating component and injects the hydrous liquid into the conduit of the disposable milk pod.

In Example 3, the subject matter of Examples 1-2 includes, wherein the conduit includes a cylinder shape.

In Example 4, the subject matter of Examples 1-3 includes, wherein the conduit includes an orifice causing the hydrous liquid to exit from the conduit and into the milk.

In Example 5, the subject matter of Example 4 includes, wherein a size of the orifice is based on a desired amount of aeration of the milk.

In Example 6, the subject matter of Examples 4-5 includes, wherein a placement of the orifice is based on a milk level or on a desired mixing intensity.

In Example 7, the subject matter of Examples 1-6 includes, wherein the conduit defines an internal channel whereby the hydrous liquid is injected from the pod processing device to the disposable milk pod through the pierced portion of the first barrier.

In Example 8, the subject matter of Examples 1-7 includes, wherein the disposable milk pod further comprises one or more arms connecting the wall portion with the conduit.

In Example 9, the subject matter of Example 8 includes, wherein the pod processing device pierces the first barrier using a first perforating component, wherein the first perforating component pierces the first barrier in between two of the plurality of arms.

In Example 10, the subject matter of Example 9 includes, wherein the first perforating component releases pressure generated by the injection of the hydrous liquid via a second perforating component.

In Example 11, the subject matter of Examples 1-10 includes, wherein the disposable milk pod further comprises a piercing component configured to pierce the disposable milk pod when engaged with the pod processing device.

In Example 12, the subject matter of Example 11 includes, wherein piercing the disposable milk pod enables exiting of the milk from the disposable milk pod.

In Example 13, the subject matter of Examples 11-12 includes, a second barrier, wherein the piercing component is configured to pierce the second barrier subsequent to the injection of the hydrous liquid into the internal chamber.

In Example 14, the subject matter of Example 13 includes, wherein the disposable milk pod includes a shelf, wherein the bottom portion includes a bottom wall of the disposable milk pod, wherein the second barrier is flush with the shelf and is separated from the bottom wall.

In Example 15, the subject matter of Examples 1-14 includes, wherein the bottom portion includes a bottom wall, wherein the bottom wall includes one or more holes allowing milk to exit from the one or more holes.

In Example 16, the subject matter of Examples 1-15 includes, wherein the bottom portion includes a bottom wall comprising a different material than the wall portion, wherein the pod processing device further pierces the bottom wall enabling the milk to exit from the disposable milk pod.

In Example 17, the subject matter of Examples 1-16 includes, wherein the conduit includes a first internal channel for injecting the hydrous liquid and a second internal channel for releasing pressure.

In Example 18, the subject matter of Examples 1-17 includes, wherein the disposable milk pod includes a second internal chamber comprising coffee.

In Example 19, the subject matter of Examples 1-18 includes, wherein the milk is in the form of powdered milk, wherein the hydrous liquid initially injected into the internal chamber comprises water, wherein the hydrous liquid subsequently injected into the internal chamber comprises steam.

In Example 20, the subject matter of Examples 1-19 includes, wherein the milk is in the form of liquid form of milk, wherein the hydrous liquid injected into the internal chamber comprises steam.

Example 21 is at least one machine-readable medium including instructions that, when executed by processing circuitry, cause the processing circuitry to perform operations to implement any of Examples 1-20.

Example 22 is an apparatus comprising means to implement any of Examples 1-20.

Example 23 is a system to implement any of Examples 1-20.

Example 24 is a method to implement any of Examples 1-20.

CONCLUSION

As used in this disclosure, phrases of the form "at least one of an A, a B, or a C," "at least one of A, B, or C," "at least one of A, B, and C," and the like, should be interpreted to select at least one from the group that comprises "A, B, and C." Unless explicitly stated otherwise in connection with a particular instance in this disclosure, this manner of phrasing does not mean "at least one of A, at least one of B, and at least one of C." As used in this disclosure, the example "at least one of an A, a B, or a C," would cover any of the following selections: {A}, {B}, {C}, {A, B}, {A, C}, {B, C}, and {A, B, C}.

Unless the context clearly requires otherwise, throughout the description and the claims, the words "comprise," "comprising," and the like are to be construed in an inclusive sense, as opposed to an exclusive or exhaustive sense, i.e., in the sense of "including, but not limited to." As used herein, the terms "connected," "coupled," or any variant thereof means any connection or coupling, either direct or indirect, between two or more elements; the coupling or connection between the elements can be physical, logical, or a combination thereof. Additionally, the words "herein," "above," "below," and words of similar import, when used in this application, refer to this application as a whole and not to any particular portions of this application. Where the context permits, words using the singular or plural number may also include the plural or singular number respectively. The word "or" in reference to a list of two or more items, covers all of the following interpretations of the word: any one of the items in the list, all of the items in the list, and any combination of the items in the list. Likewise, the term "and/or" in reference to a list of two or more items, covers all of the following interpretations of the word: any one of the items in the list, all of the items in the list, and any combination of the items in the list.

Although some examples, e.g., those depicted in the drawings, include a particular sequence of operations, the sequence may be altered without departing from the scope of the present disclosure. For example, some of the operations depicted may be performed in parallel or in a different sequence that does not materially affect the functions as described in the examples. In other examples, different components of an example device or system that implements an example method may perform functions at substantially the same time or in a specific sequence.

The various features, steps, and processes described herein may be used independently of one another, or may be combined in various ways. All possible combinations and subcombinations are intended to fall within the scope of this disclosure. In addition, certain method or process blocks may be omitted in some implementations.

What is claimed is:

1. A disposable milk pod comprising:

an internal chamber containing milk;

a bottom portion;

a top portion, wherein the top portion comprises a first barrier, the first barrier including a film configured to be pierced by a pod processing device;

a wall portion connecting the bottom and top portions, wherein prior to the disposable milk pod engaging with the pod processing device, the first barrier, the bottom portion, and the wall portion seal the milk within the internal chamber;

a conduit comprising an outer wall, a channel, an orifice creating an opening on the outer wall, and an opening to the channel, and a second barrier, wherein:

the opening to the channel is connected to the channel and the opening to the channel is configured to transfer a hydrous liquid from the pod processing device to the channel;

the channel of the conduit is connected to the orifice;

the orifice is configured to transfer the hydrous liquid from the channel into the internal chamber via the orifice causing the milk to mix with the hydrous liquid within the internal chamber, wherein the orifice is configured to transfer the hydrous liquid subsequent to the pod processing device engaging with the disposable milk pod, the milk being stored in the internal chamber prior to the milk pod engaging with the pod processing device; and the disposable milk pod is configured to enable the piercing component to pierce the second barrier subsequent to the engaging with the pod processing device while impeding the milk from exiting from the pierced portion by blocking the pierced portion via the piercing component of the disposable milk pod.

2. The disposable milk pod of claim 1, wherein the conduit includes a cylinder shape.

3. The disposable milk pod of claim 1, wherein the orifice is created at a size configured to generate a certain amount of aeration of the milk.

4. The disposable milk pod of claim 1, wherein the orifice is placed at a location configured to mix the hydrous liquid and the milk to a certain mixing intensity.

5. The disposable milk pod of claim 1, wherein the disposable milk pod further comprises a plurality of arms connecting the wall portion with the conduit.

6. The disposable milk pod of claim 5, wherein the first barrier is configured to be pierced by the pod processing device using a first perforating component, two of the plurality of arms originally being separated enabling the first perforating component to pierce the first barrier in between two of the plurality of arms.

7. The disposable milk pod of claim 1, wherein the film covers the conduit and a portion of a top side of the internal chamber such that in response to the pod processing device engaging with the disposable milk pod, the disposable milk pod is configured to enable a first perforating component to pierce the first barrier and enter into the internal chamber where the milk is being stored in order to cause the release of pressure generated by the transfer of the hydrous liquid into the internal chamber via a pierced portion of the first barrier by a second perforating component.

8. The disposable milk pod of claim 1, wherein the disposable milk pod further comprises a piercing component configured to pierce the disposable milk pod when engaged with the pod processing device.

9. The disposable milk pod of claim 8, wherein piercing the disposable milk pod enables exiting of the milk from the disposable milk pod.

10. The disposable milk pod of claim 1, wherein the disposable milk pod includes a shelf comprised of an indent of the wall portion and the bottom portion of the disposable milk pod, wherein the bottom portion includes a bottom external wall of the disposable milk pod configured to allow milk to exit from the disposable milk pod, wherein the second barrier is parallel and flush with the shelf, the second barrier is separated from the bottom wall.

11. The disposable milk pod of claim 1, wherein the bottom portion includes a bottom wall, wherein the bottom wall includes one or more holes allowing milk to exit from the one or more holes.

12. The disposable milk pod of claim 1, wherein the bottom portion includes a bottom wall comprising a different material than the wall portion, wherein the pod processing device further pierces the bottom wall enabling the milk to exit from the disposable milk pod.

13. The disposable milk pod of claim 1, wherein the conduit includes a first internal channel for injecting the hydrous liquid and a second internal channel for releasing pressure.

14. The disposable milk pod of claim 1, wherein the disposable milk pod includes a second internal chamber comprising coffee.

15. The disposable milk pod of claim 1, wherein the milk is in the form of powdered milk, wherein the hydrous liquid initially injected into the internal chamber comprises water, wherein the hydrous liquid subsequently injected into the internal chamber comprises steam.

16. The disposable milk pod of claim 1, wherein the milk is in a liquid form of milk, wherein the hydrous liquid injected into the internal chamber comprises steam.

17. The disposable milk pod of claim 1, wherein the orifice is placed on the outer wall of the conduit based on a milk level of the milk inside of the internal chamber.

18. The disposable milk pod of claim 1, wherein in response to disengaging with the pod processing device, the disposable milk pod is configured to allow the milk to exit from the pierced portion by retracting the conduit from the pierced portion.

19. The disposable milk pod of claim 1, wherein in response to the orifice transferring the hydrous liquid from the channel into the internal chamber via the orifice, the disposable milk pod configured to cause all the milk stored in the disposable milk pod to mix with the hydrous liquid within the internal chamber.

20. The disposable milk pod of claim 1, wherein the second barrier is above one or more holes of the disposable milk pod configured to allow the milk to exit from the disposable milk pod.

21. The disposable milk pod of claim 20, wherein the one or more holes of the disposable milk pod is pre-existing prior to engagement with the pod processing device.

* * * * *